US011199805B2

(12) United States Patent
Furuta et al.

(10) Patent No.: US 11,199,805 B2
(45) Date of Patent: Dec. 14, 2021

(54) IMAGE FORMING APPARATUS

(71) Applicant: CANON KABUSHIKI KAISHA, Tokyo (JP)

(72) Inventors: Kiyoshi Furuta, Suntou-gun (JP); Ryosuke Takahashi, Kawasaki (JP); Masaki Iwase, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/742,234

(22) Filed: Jan. 14, 2020

(65) Prior Publication Data

US 2020/0233370 A1 Jul. 23, 2020

(30) Foreign Application Priority Data

Jan. 17, 2019 (JP) ..... JP2019-005954
Mar. 6, 2019 (JP) ..... JP2019-040681

(51) Int. Cl.
*G03G 21/16* (2006.01)

(52) U.S. Cl.
CPC ..... *G03G 21/1633* (2013.01)

(58) Field of Classification Search
CPC ..... G03G 21/1633
See application file for complete search history.

(56) References Cited

U.S. PATENT DOCUMENTS 6,768,877 B2 7/2004 Alegria et al.
2010/0329704 A1* 12/2010 Tachibana ..... G03G 15/0855 399/27

* cited by examiner

*Primary Examiner* — Sevan A Aydin
(74) *Attorney, Agent, or Firm* — Venable LLP

(57) ABSTRACT

An image forming apparatus includes a main assembly; an openable member, provided with a portion-to-be-engaged, for covering a mounting portion; an engaging member provided on the main assembly for engaging with the portion-to-be-engaged of the openable member positioned at a closed position so as to restrict movement of the openable member relative to the main assembly; a locking portion for locking the engaging member in an engaged state with the portion-to-be-engaged by restricting movement of the engaging member; an electric driving portion for unlocking the locking portion; a discriminating portion for discriminating that a consumable mounted is in an exchange state in which the consumable is to be exchanged; and a controller for driving the electric driving portion so as to unlock the locking portion when the controller receives, from the determining portion, a signal for determining that the consumable is in the exchange state.

26 Claims, 30 Drawing Sheets

(a)

(b)

(a)

(b)

(a)

(b)

(a)

(b)

(a)

(b)

(a)

(b)

(a)

(b)

(a)

(b)

(a)

(b)

IMAGE FORMING APPARATUS

FIELD OF THE INVENTION AND RELATED ART

The present invention relates to an image forming apparatus capable of mounting and dismounting of a consumable such as a developer cartridge for supplying a developer for image formation.

In the image forming apparatus such as a laser printer, an ink jet printer or a copying machine, in the case where the developer cartridge for supplying the developer for image formation has been used up, a user or a service person exchanges the developer cartridge with a new (fresh) developer cartridge.

In this exchanging operation, the user (service person) opens an openable cover of an apparatus main assembly and has access to an inside of the apparatus main assembly, and then exchanges the developer cartridge in general (U.S. Pat. No. 6,768,877).

In such an exchange of the developer cartridge, in some cases, the user erroneously opened the openable cover before the developer in the developer cartridge was completely consumed, and exchanged the developer cartridge which was still usable.

However, such as an early exchange of the developer cartridge which was still usable results in an excessive cost to the user.

SUMMARY OF THE INVENTION

The present invention has been accomplished in view of the above-described circumstances. A principal object of the present invention is to provide an image forming apparatus capable of preventing early exchange of a consumable such as a developer cartridge which is still usable.

According to an aspect of the present invention, there is provided an image forming apparatus comprising: a main assembly; an openable member provided with a portion-to-be-engaged and configured to cover a mounting portion where a consumable for image formation is mounted; an engaging member provided on the main assembly and configured to engage with the portion-to-be-engaged of the openable member positioned at a closed position so as to restrict movement of the openable member relative to the main assembly; a locking portion configured to lock the engaging member in an engaged state with the portion-to-be-engaged by restricting movement of the engaging member; an electric driving portion configured to unlock the locking portion; a determining portion configured to determine that the consumable mounted is in an exchange state in which the consumable is to be exchanged; and a controller configured to drive the electric driving portion so as to unlock of the locking portion when the controller receives, from the determining portion, a signal for determining that the consumable is in the exchange state.

Further features of the present invention will become apparent from the following description of exemplary embodiments with reference to the attached drawings.

Figure 3:
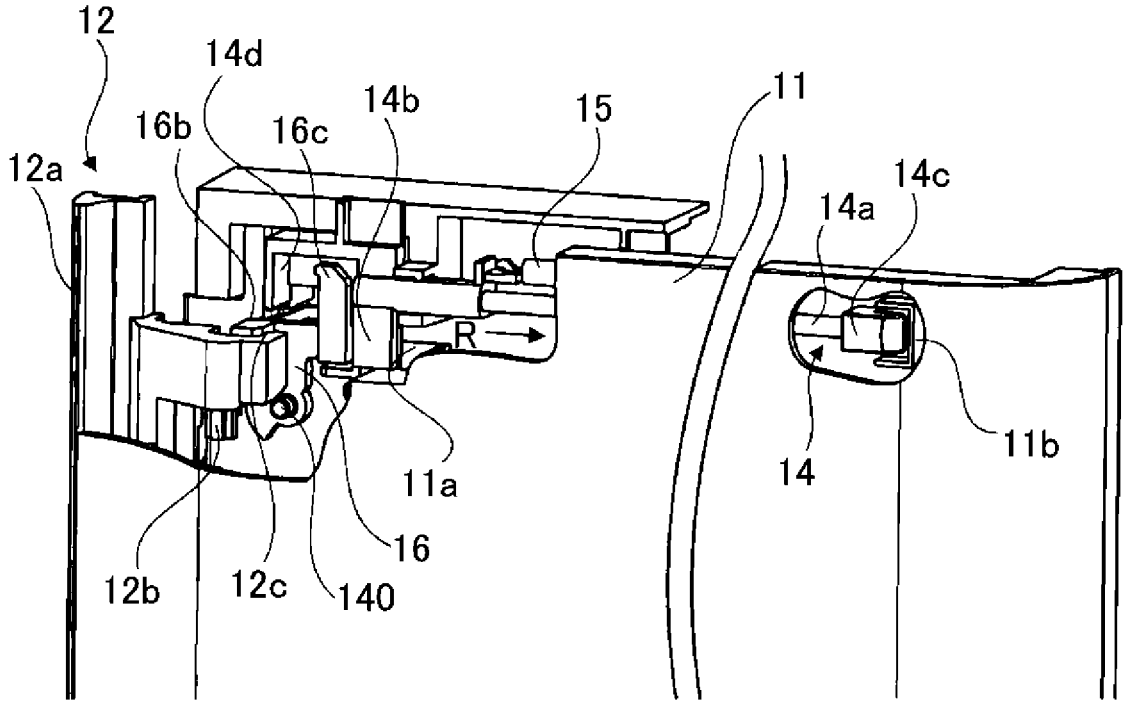
Figure 3:
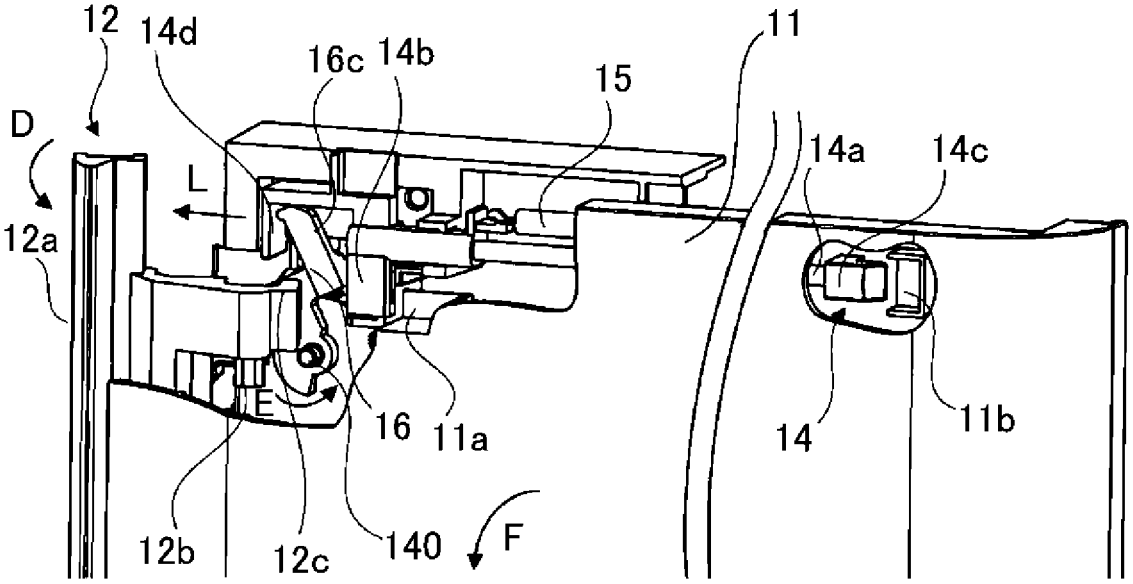

Parts (a) and (b) of FIG. 3 are perspective views of a principal part of an openable cover holding mechanism in the first embodiment.

Figure 4:
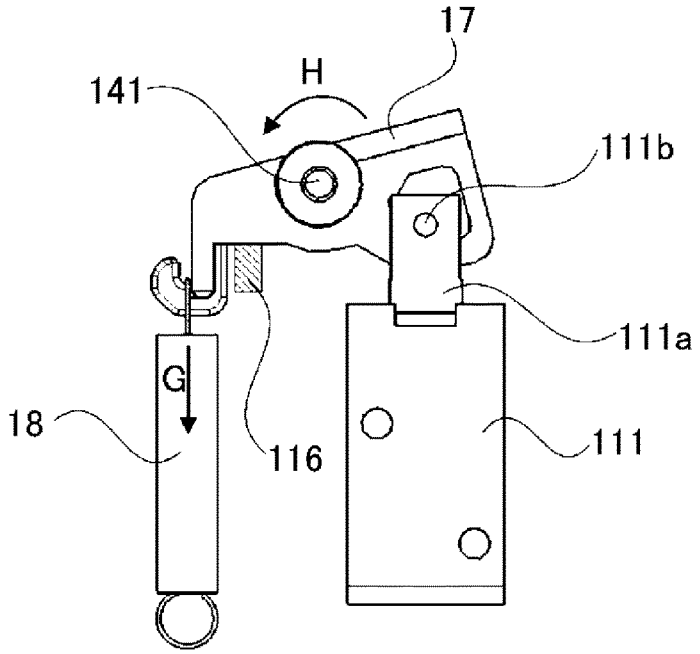
Figure 4:
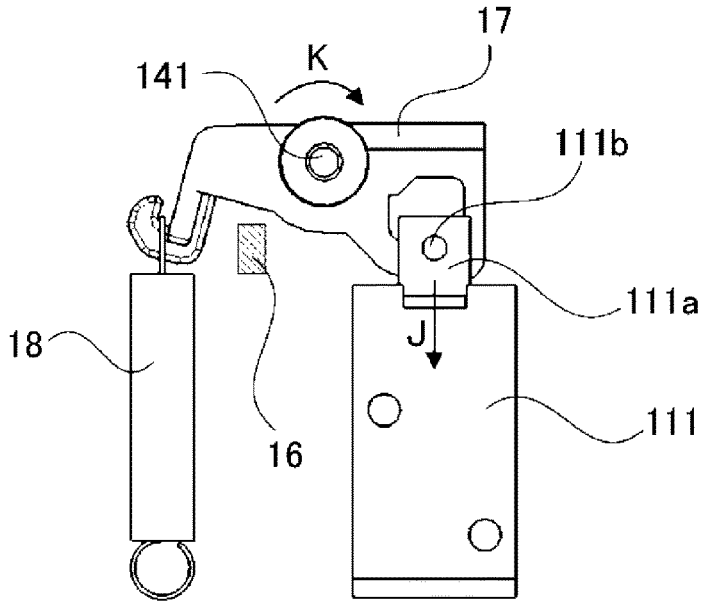

Parts (a) and (b) of FIG. 4 are sectional views of a driving portion of a locking mechanism for locking an openable cover in a closed state in the first embodiment.

Figure 5:
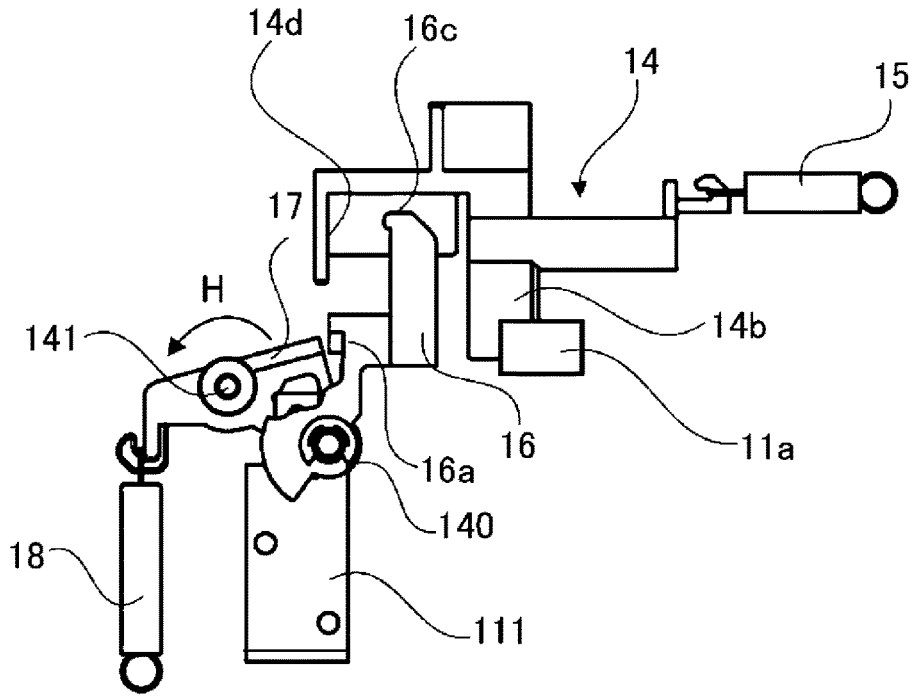
Figure 5:
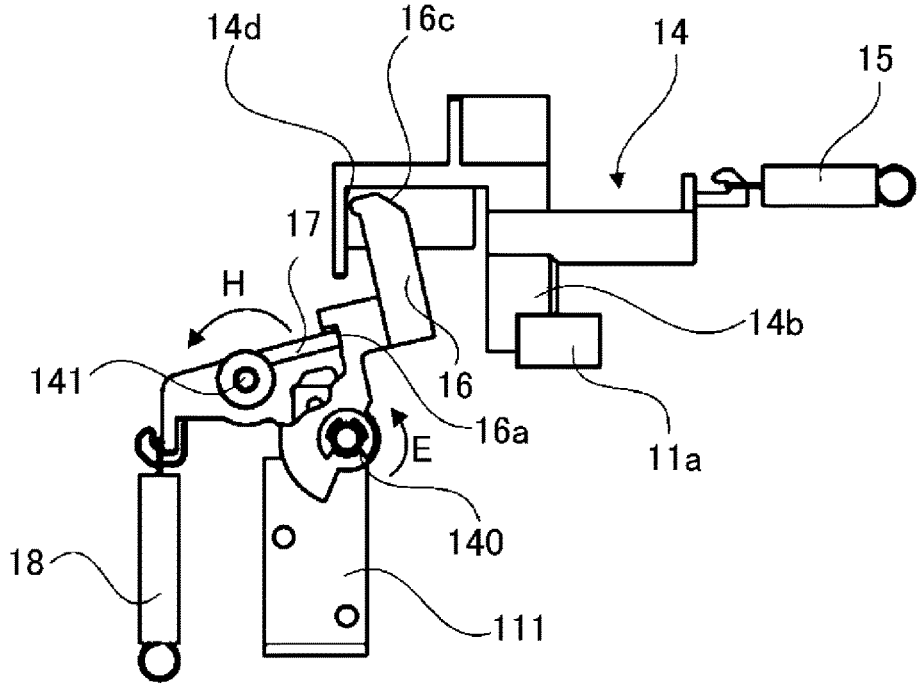

Parts (a) and (b) of FIG. 5 are sectional views for illustrating a locking operation of the locking mechanism for locking the openable cover in the closed state in the first embodiment.

Figure 6:
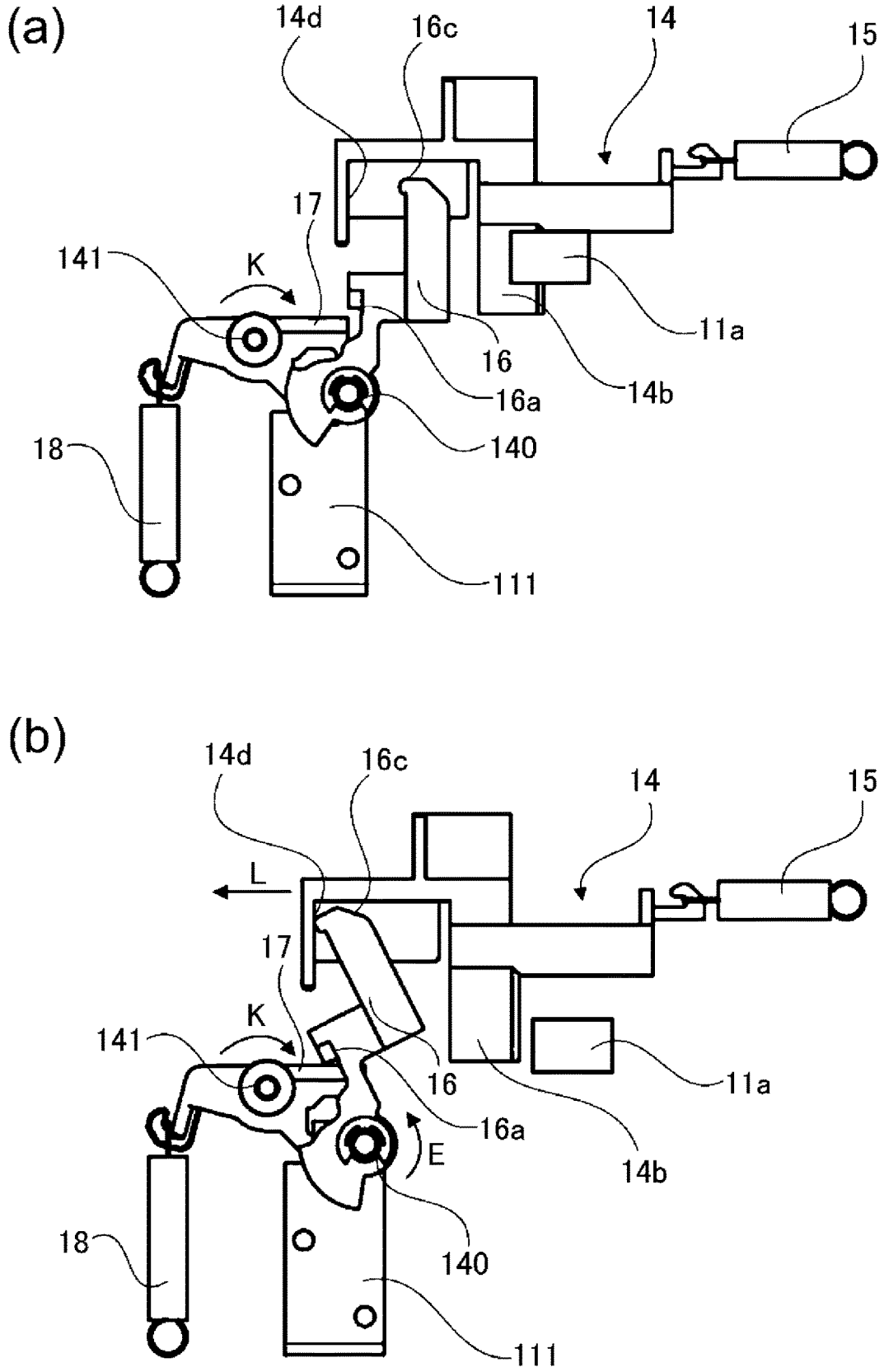

Parts (a) and (b) of FIG. 6 are sectional views for illustrating a lock releasing operation of the locking mechanism for locking the openable cover in the closed state in the first embodiment.

Figure 7:
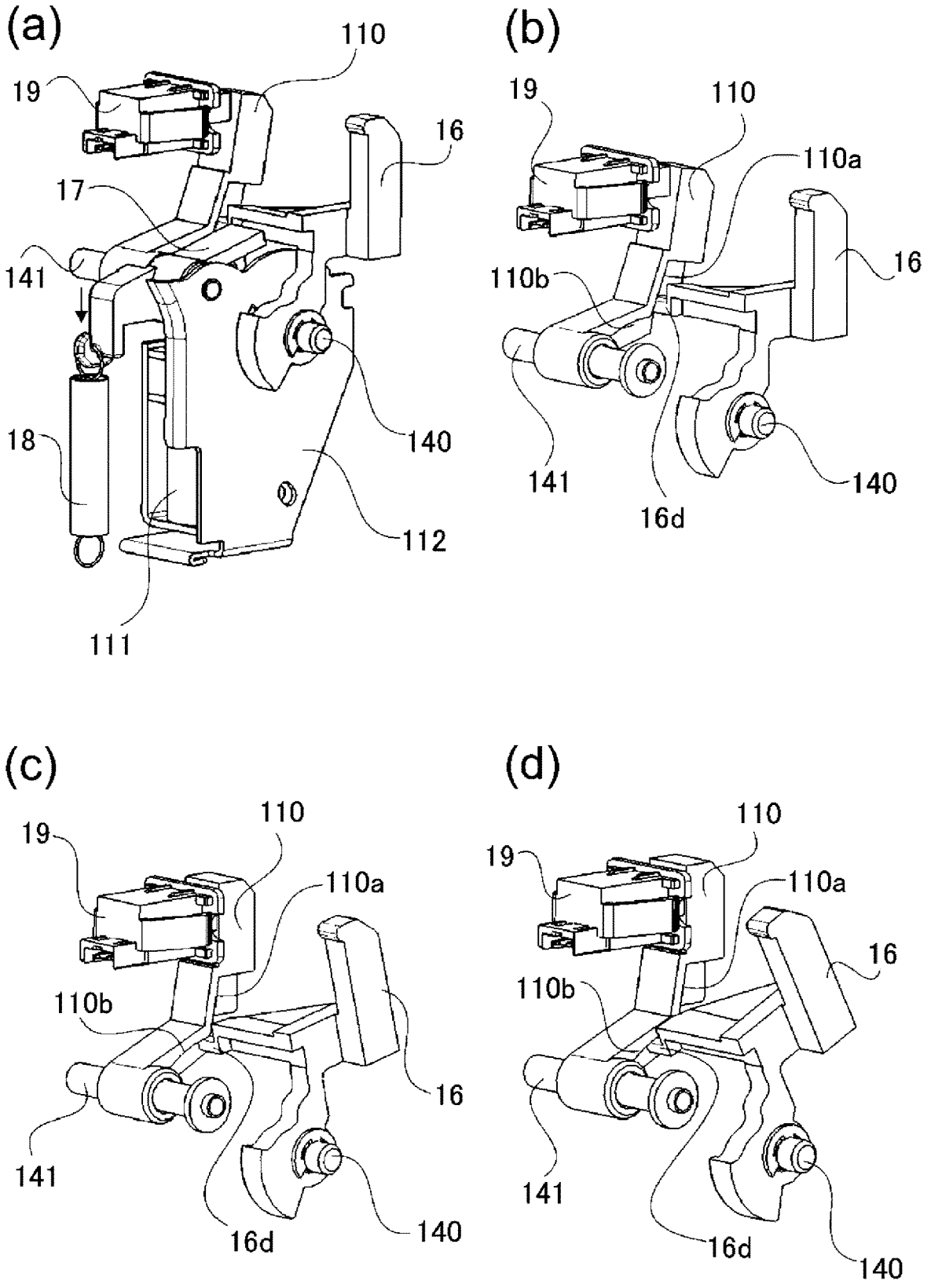

Parts (a) to (d) of FIG. 7 are perspective views of an operation detecting mechanism for detecting an opening operation of the openable cover in the first embodiment.

Figure 8:
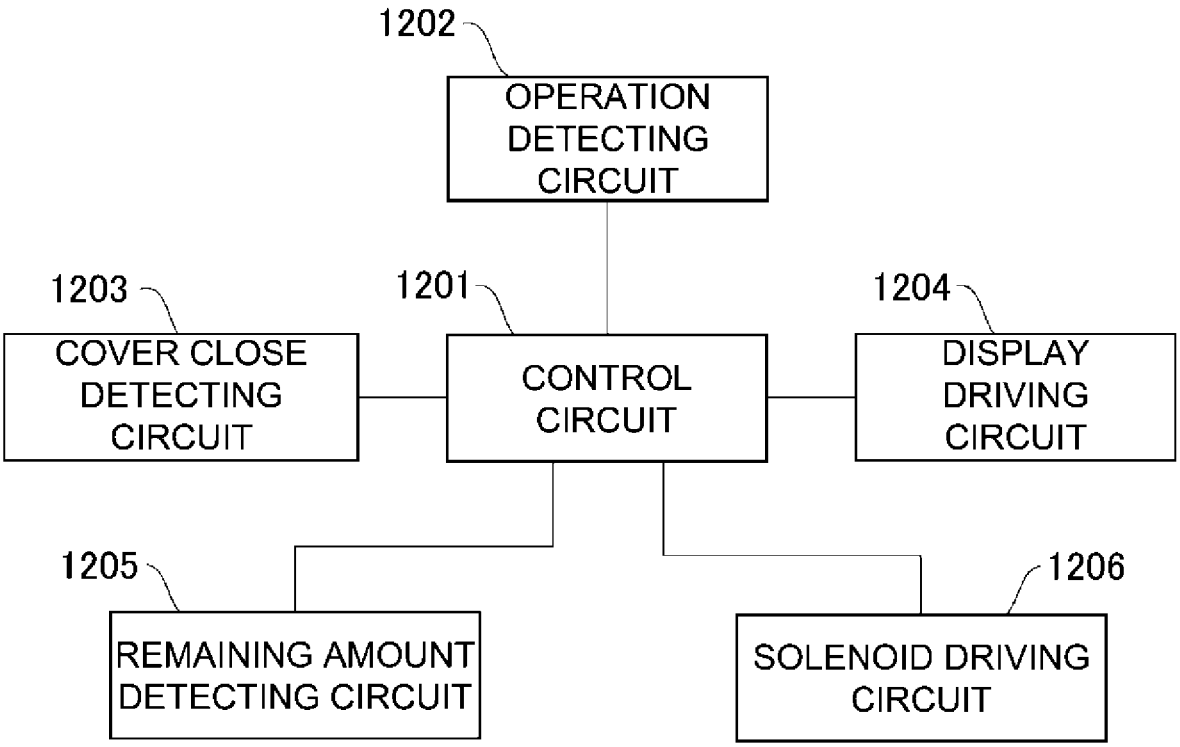

FIG. 8 is a circuit block diagram showing a constitution of control in the first embodiment.

Figure 9:
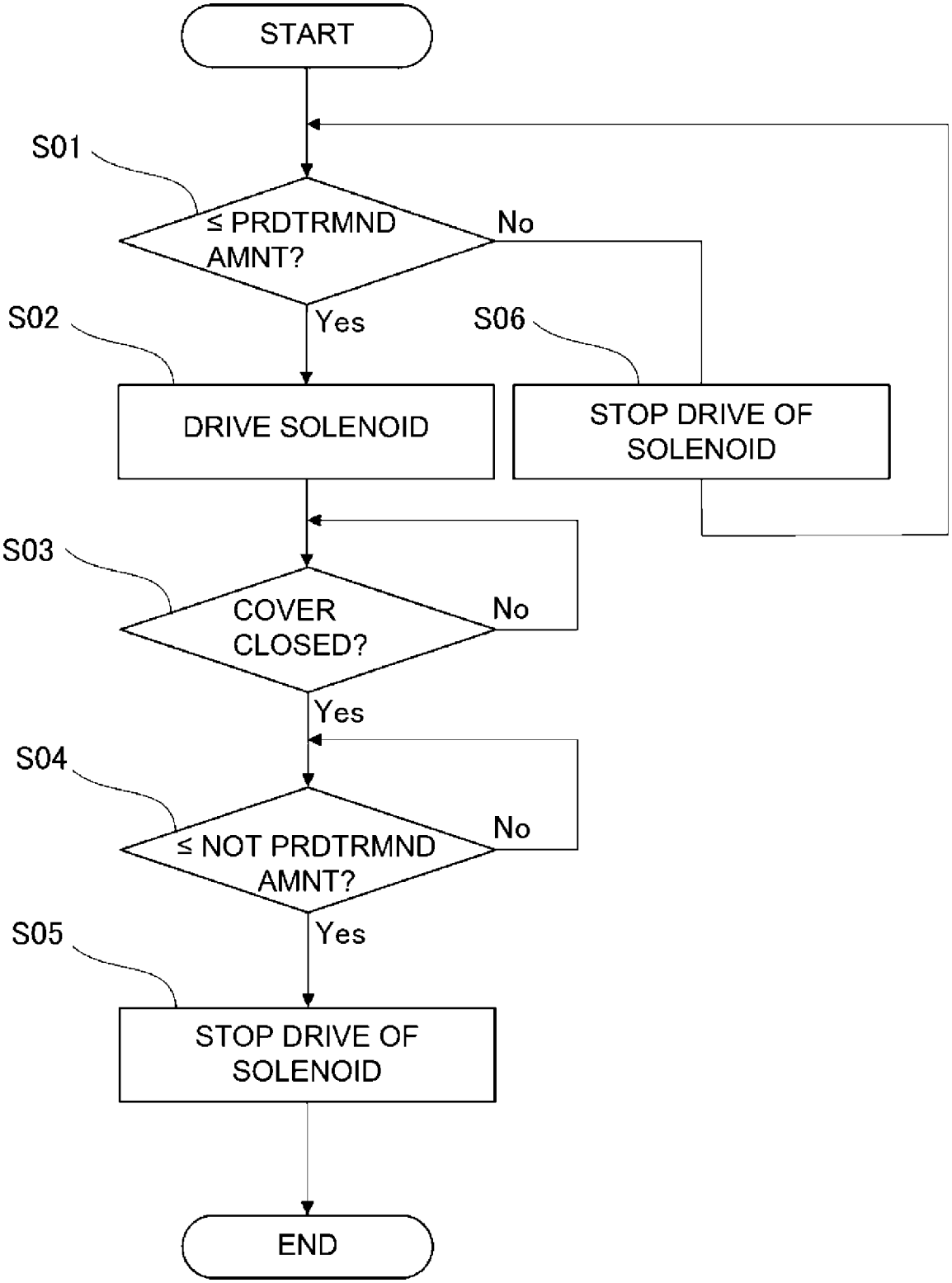

FIG. 9 is a flowchart of a control circuit of FIG. 8 in the first embodiment.

Figure 10:
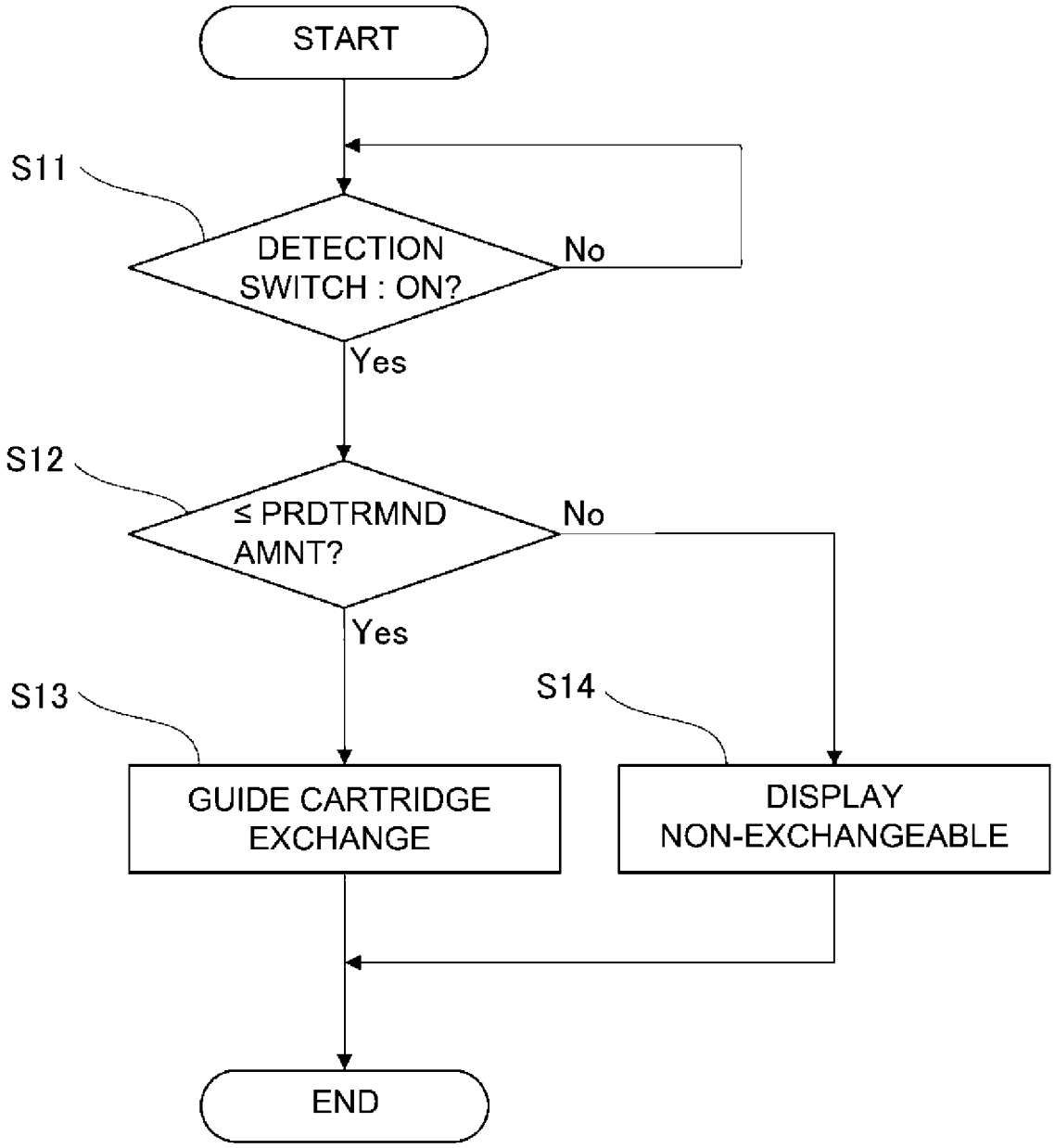

FIG. 10 is a flowchart of the control circuit of FIG. 8 in the first embodiment.

Figure 11:
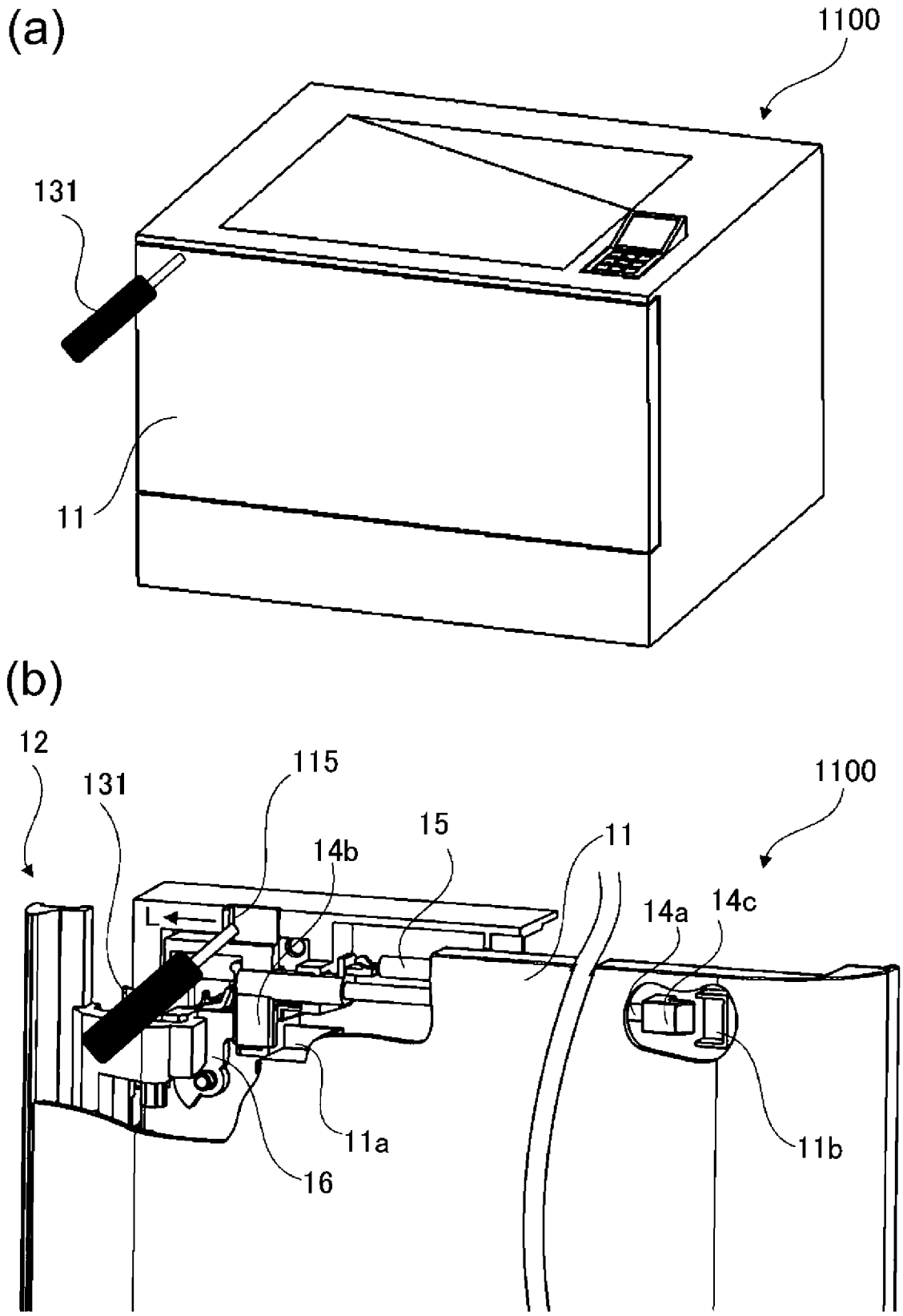

Parts (a) and (b) of FIG. 11 are perspective views of a principal part for illustrating a structure in which the locking mechanism locking the openable cover in the closed state is manually released (eliminated) in the first embodiment.

Figure 12:
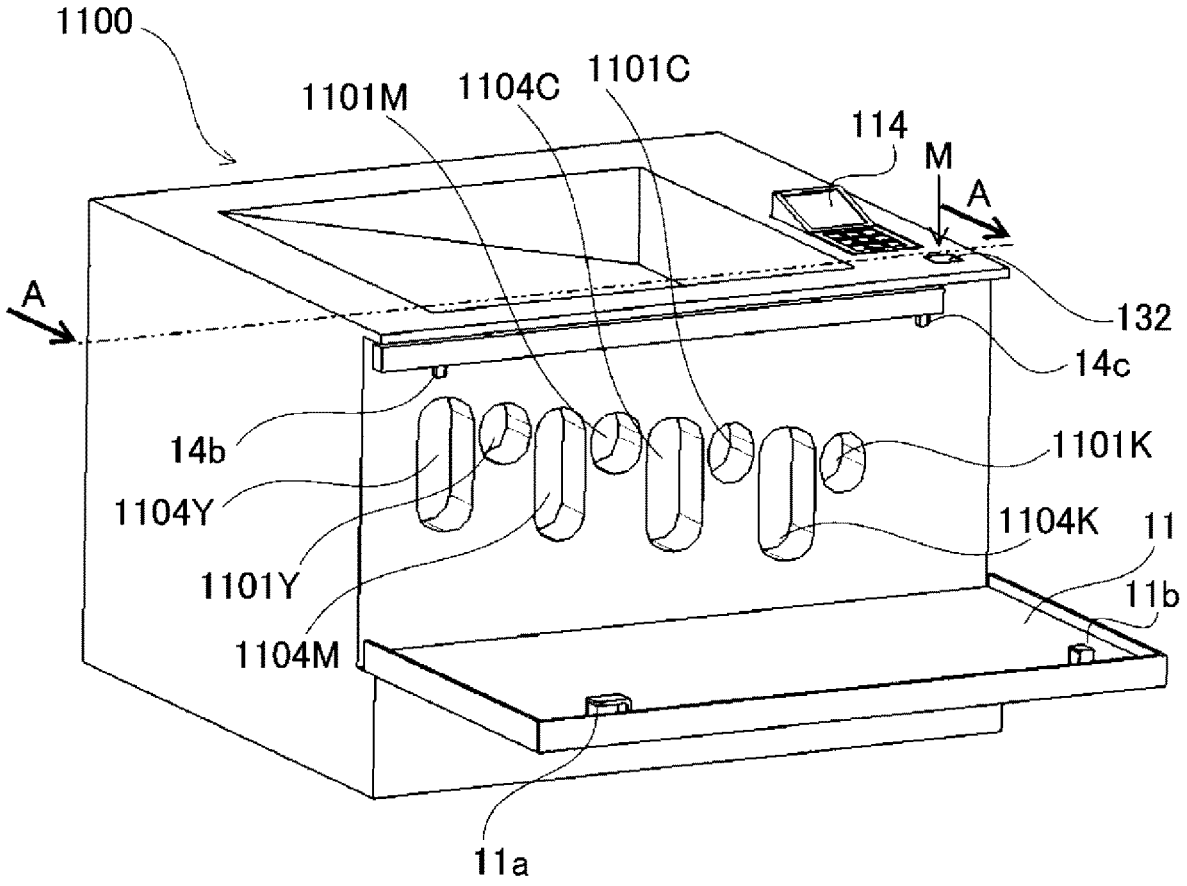

FIG. 12 is a perspective view of a printer according to a second embodiment.

Figure 13:
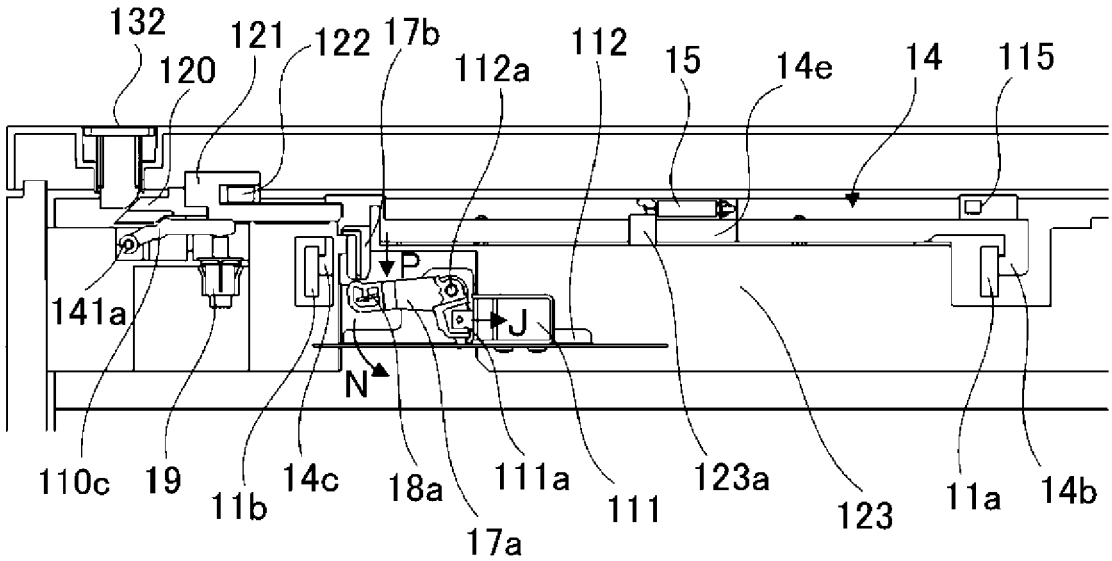
Figure 13:
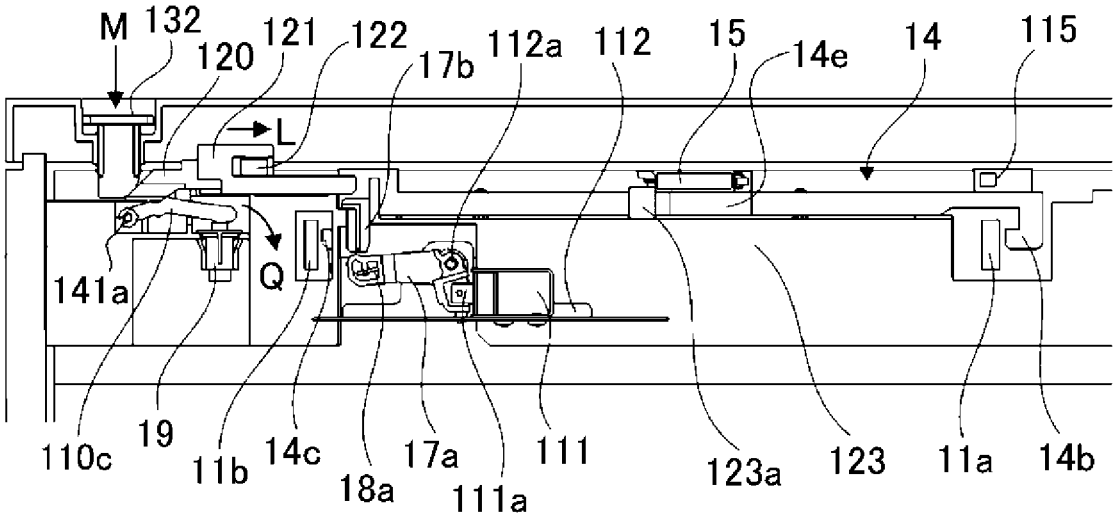

Parts (a) and (b) of FIG. 13 are sectional views, taken along A-A line of FIG. 12, showing a state in which a locking mechanism for locking an openable cover in a closed state is released in the second embodiment.

Figure 14:
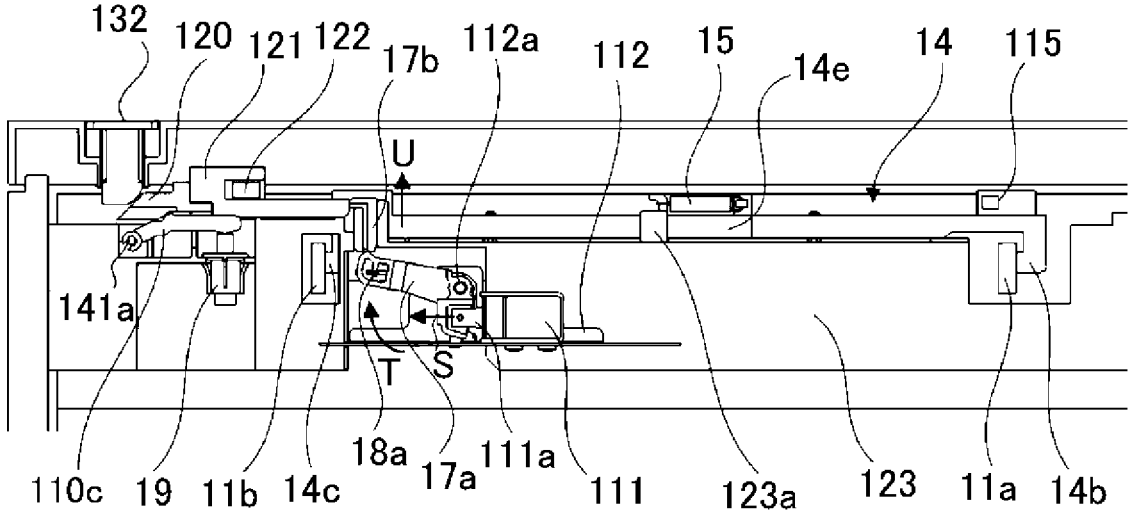
Figure 14:
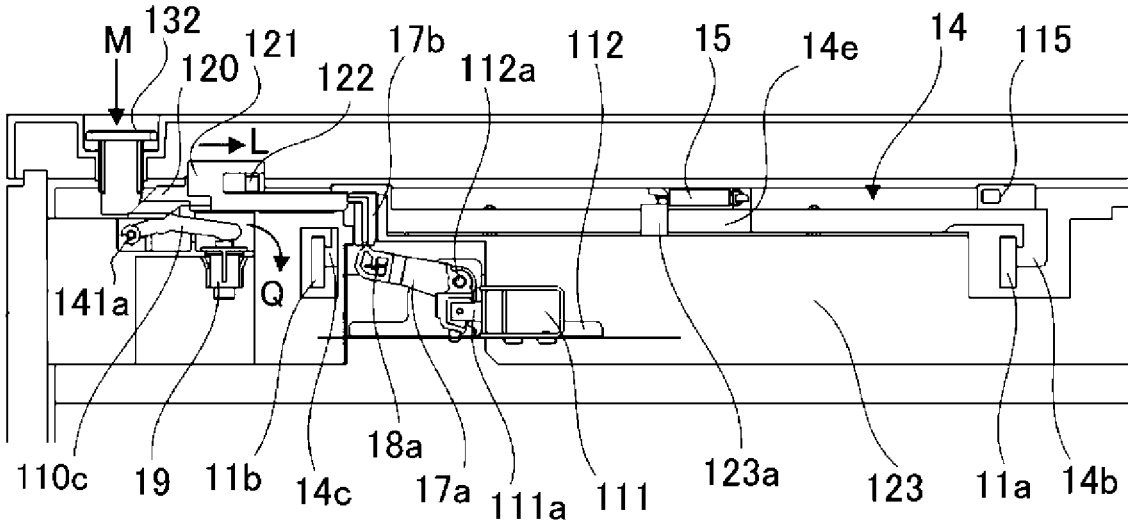

Parts (a) and (b) of FIG. 14 are sectional views, taken along A-A line of FIG. 12, showing a state in which the locking mechanism for locking the openable cover in the closed state is in a locked state in the second embodiment.

Figure 15:
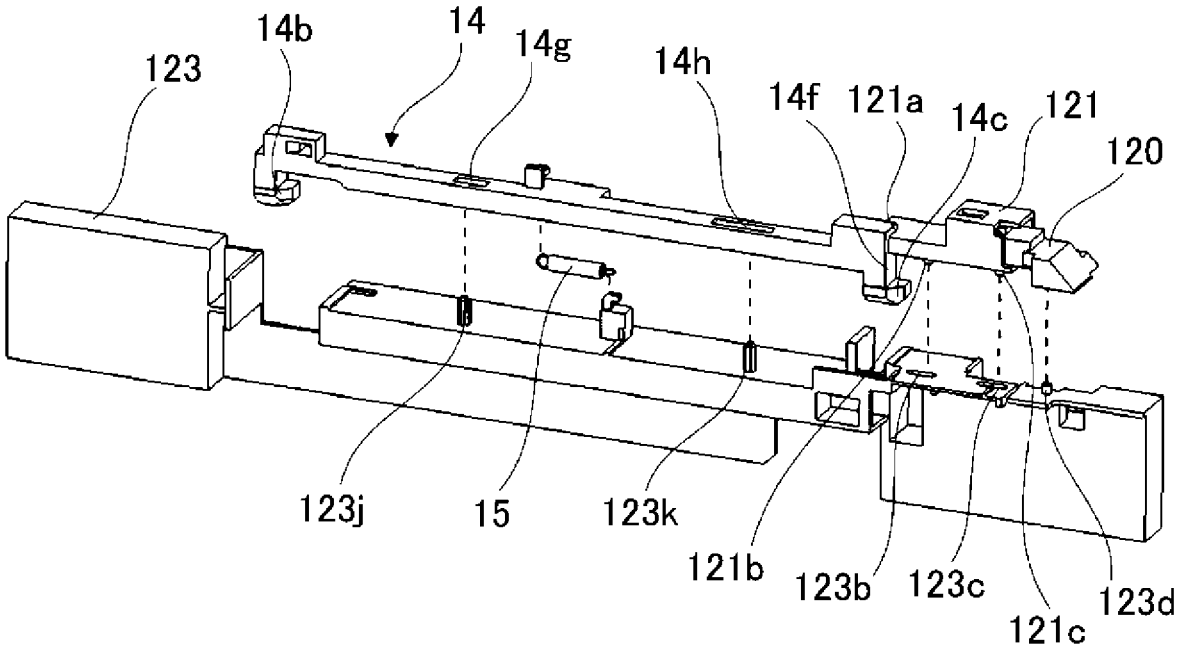

FIG. 15 is an exploded perspective view of a principal part of FIG. 13 in the second embodiment.

Figure 16:
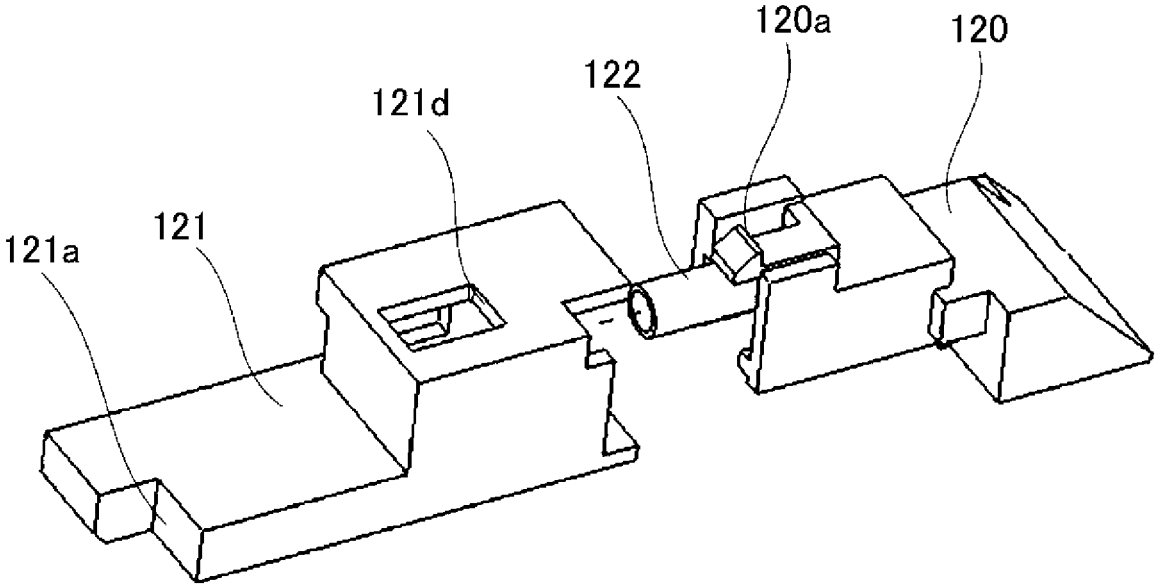

FIG. 16 is an enlarged exploded perspective view of the principal part of FIG. 13 in the second embodiment.

Figure 17:
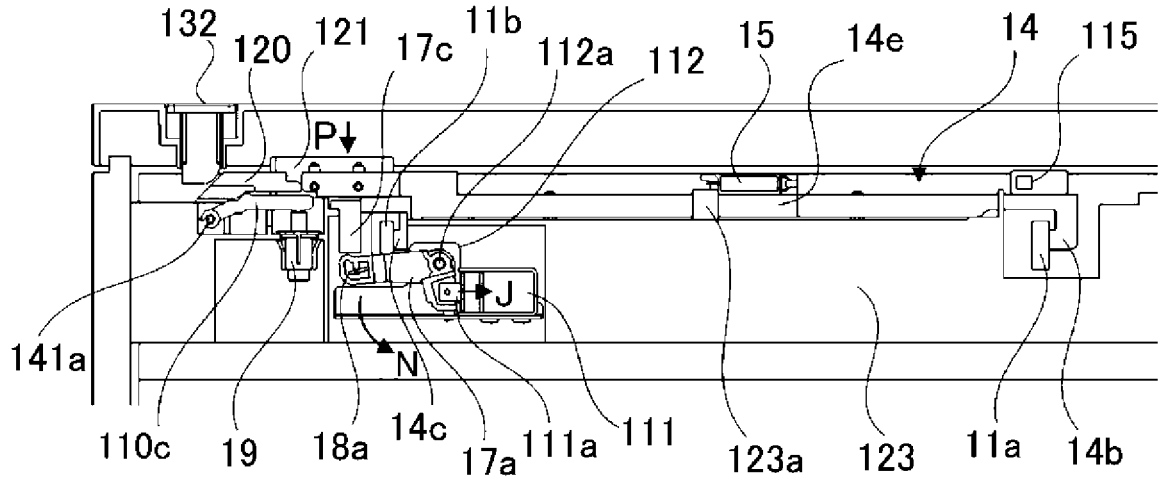
Figure 17:
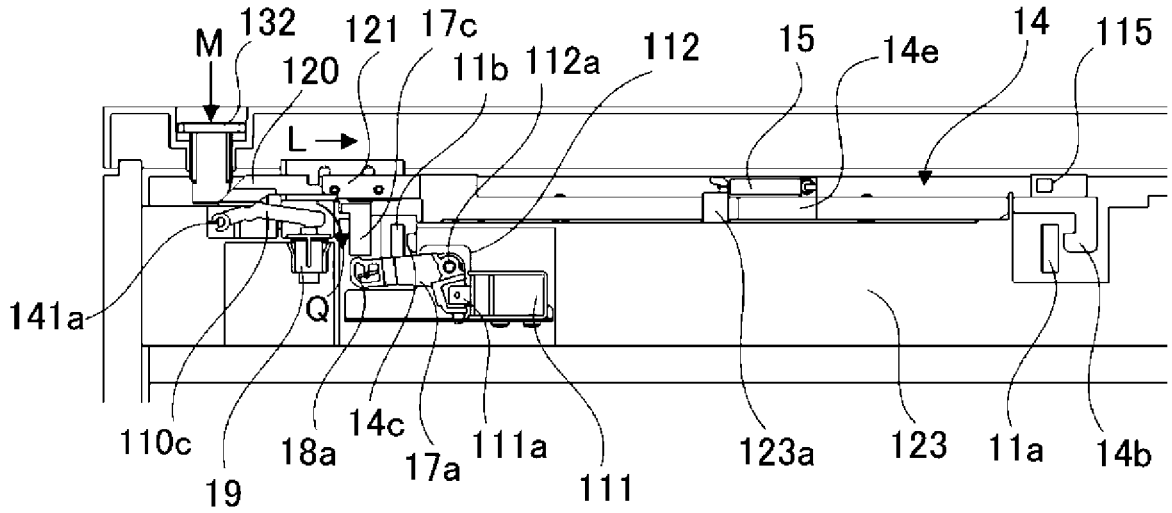

Parts (a) and (b) of FIG. 17 are sectional views, taken along A-A line of FIG. 12, showing a state in which a locking mechanism for locking an openable cover in a closed state is released in a third embodiment.

Figure 18:
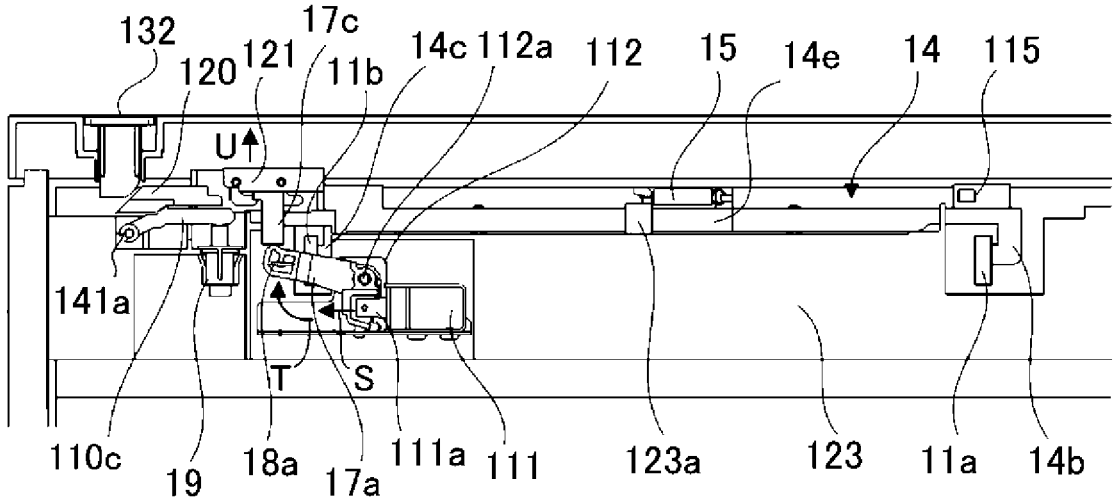
Figure 18:
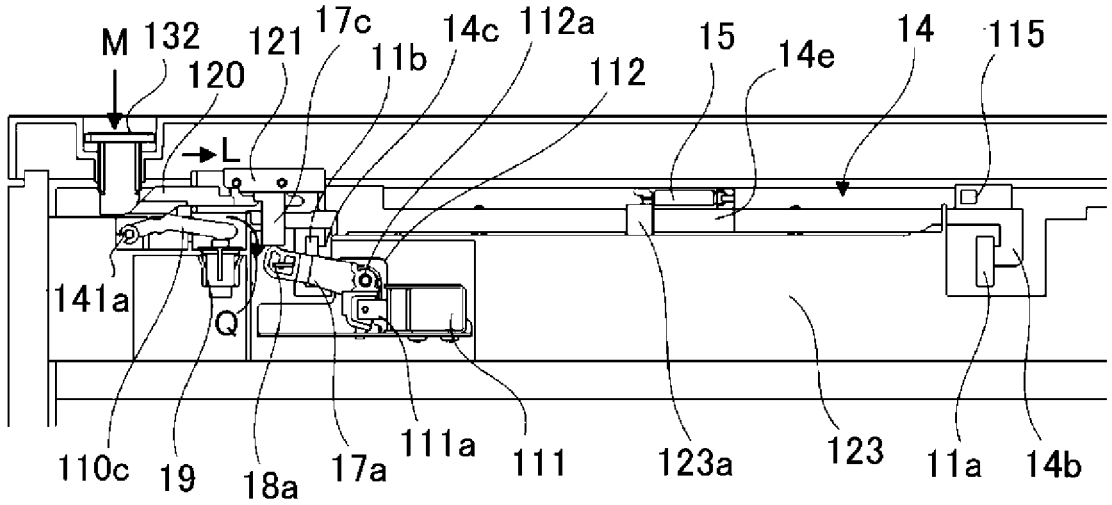

Parts (a) and (b) of FIG. 18 are sectional views, taken along A-A line of FIG. 12, showing a state in which the locking mechanism for locking the openable cover in the closed state is in a locked state in the third embodiment.

Figure 19:
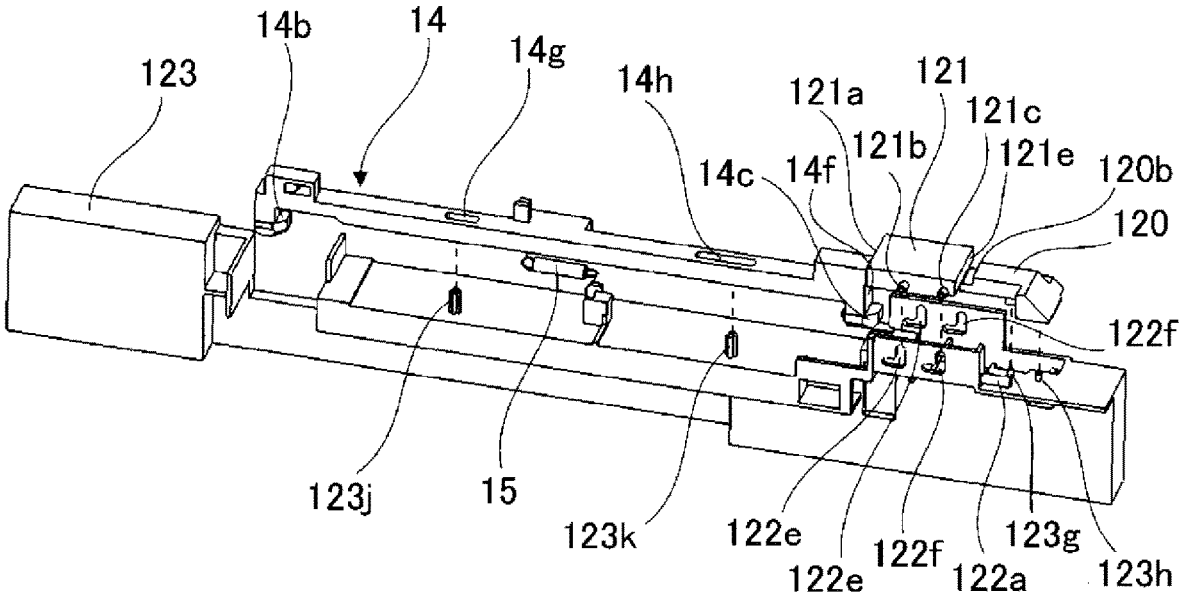

FIG. 19 is an exploded perspective view of a principal part of FIG. 17 in the third embodiment.

Figure 20:
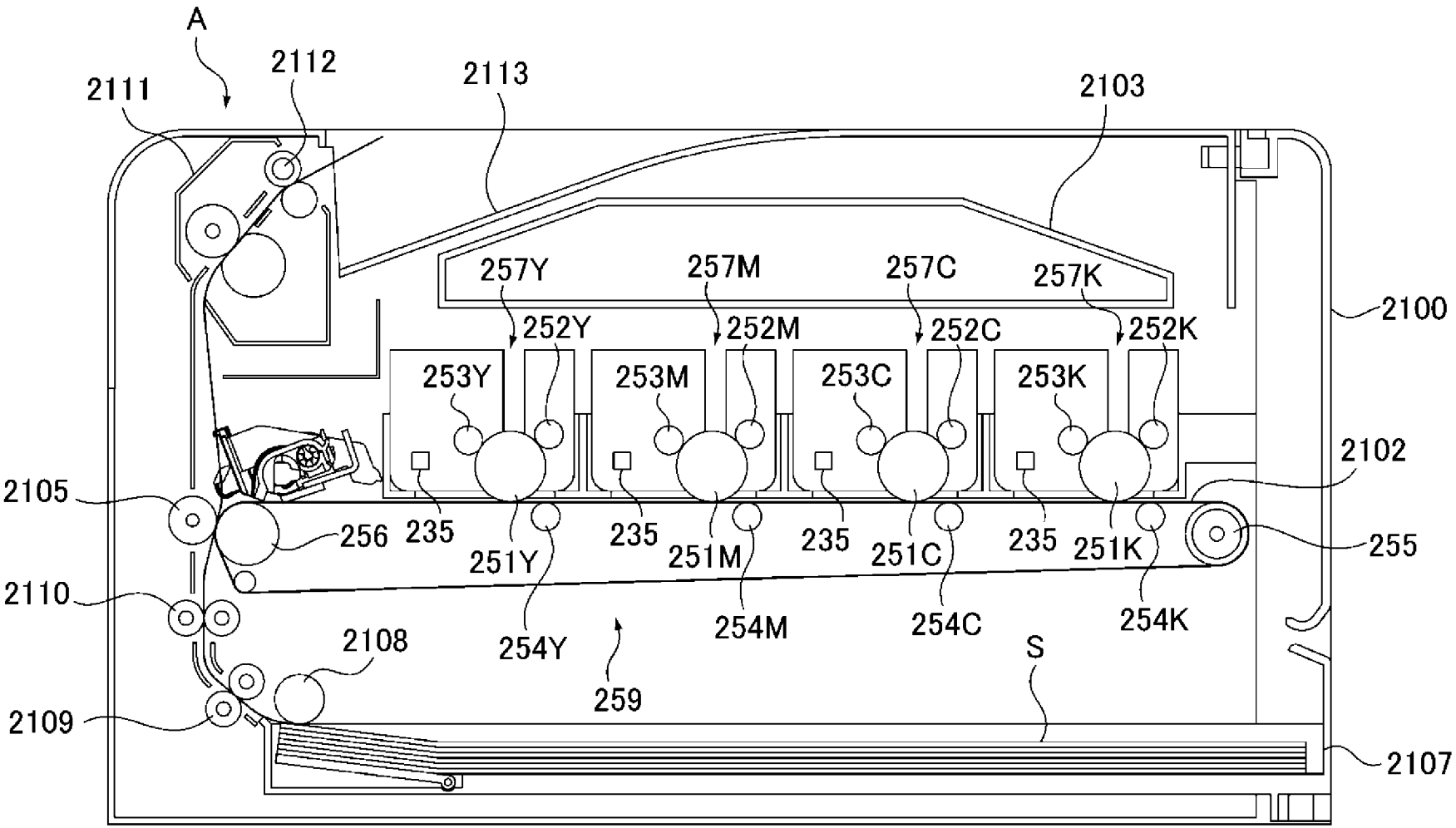

FIG. 20 is a schematic sectional view of an image forming apparatus according to a fourth embodiment.

Figure 21:
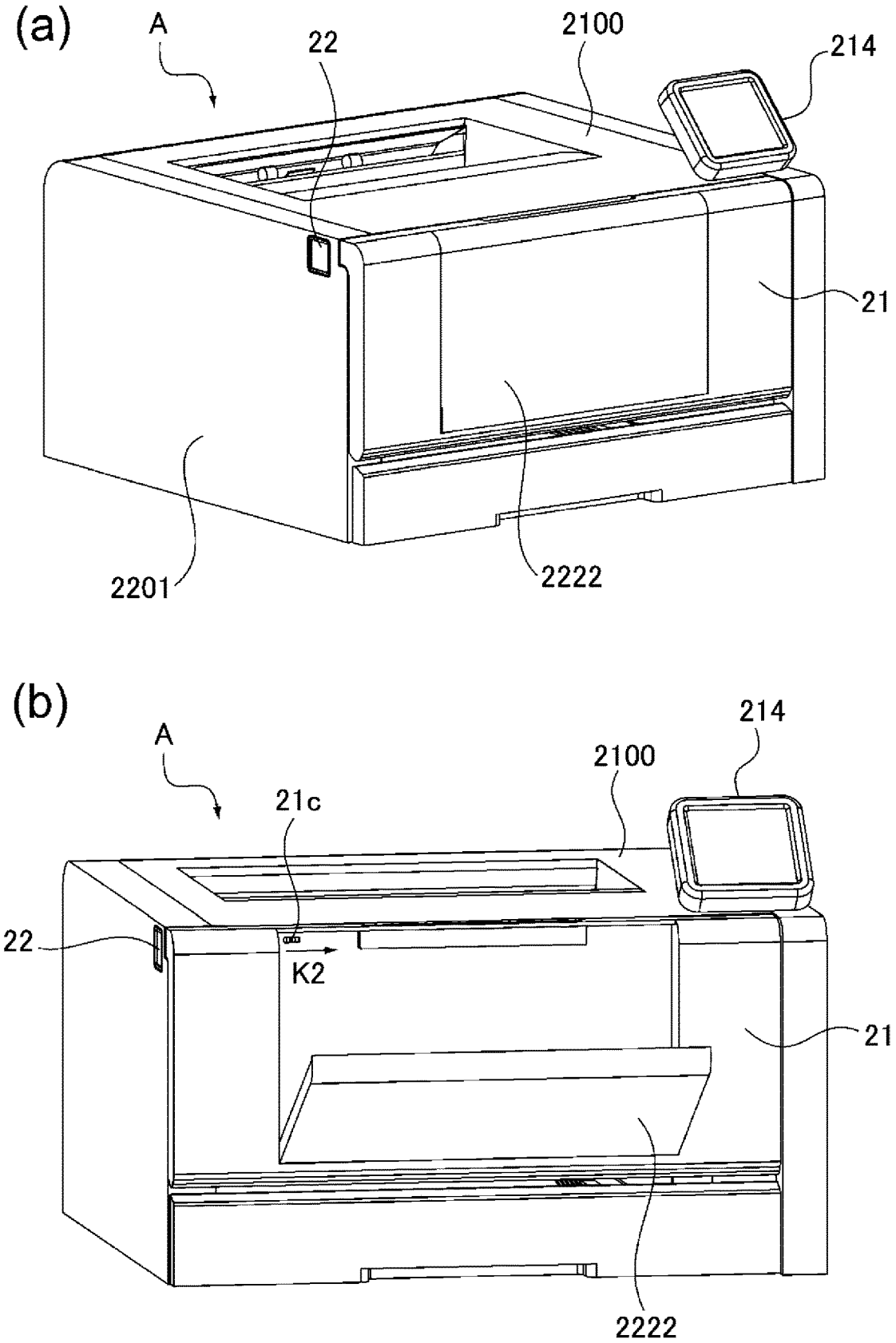

Parts (a) and (b) of FIG. 21 are perspective views of the image forming apparatus according to the fourth embodiment.

Figure 22:
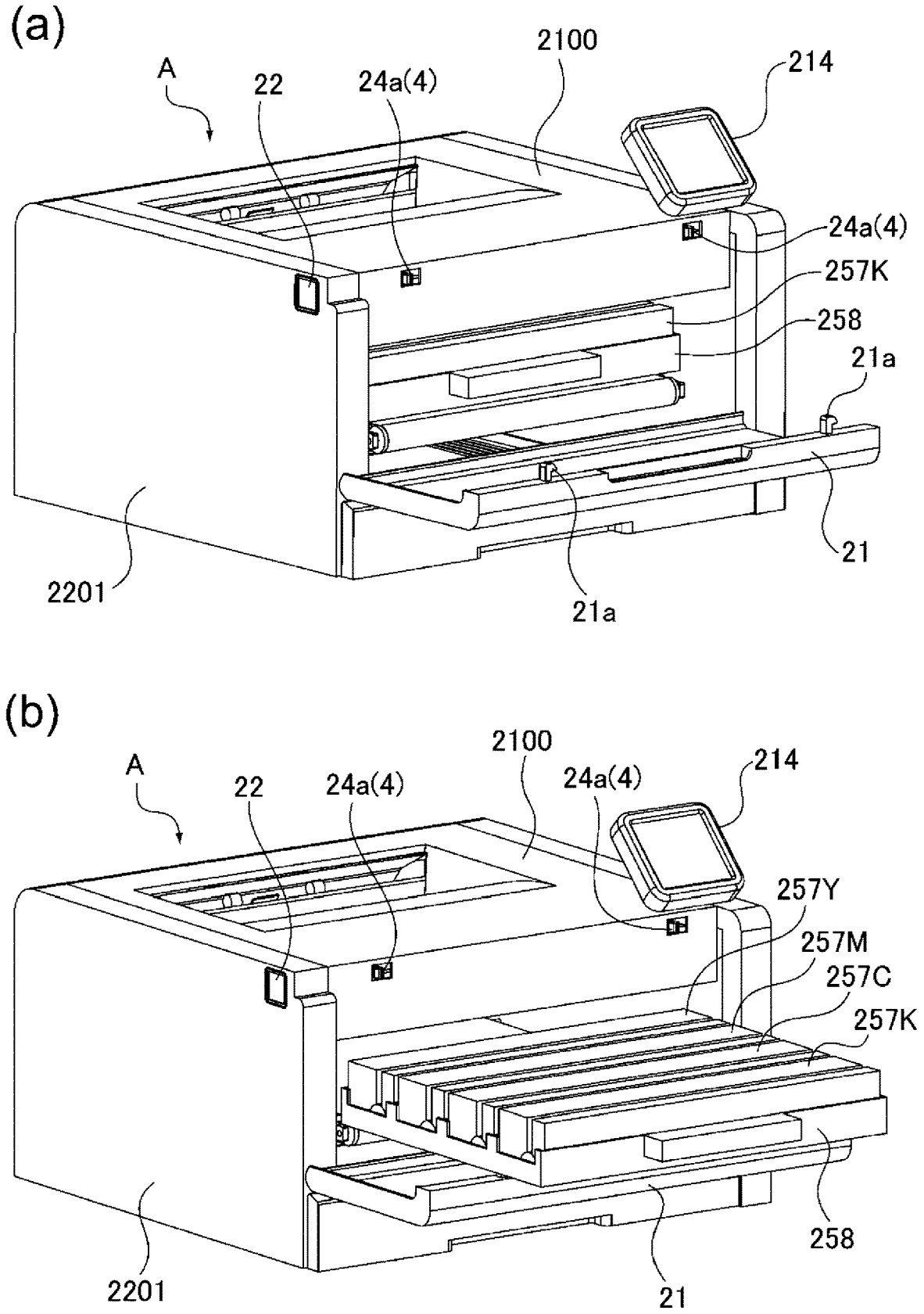

Parts (a) and (b) of FIG. 22 are perspective views of the image forming apparatus according to the fourth embodiment.

Figure 23:
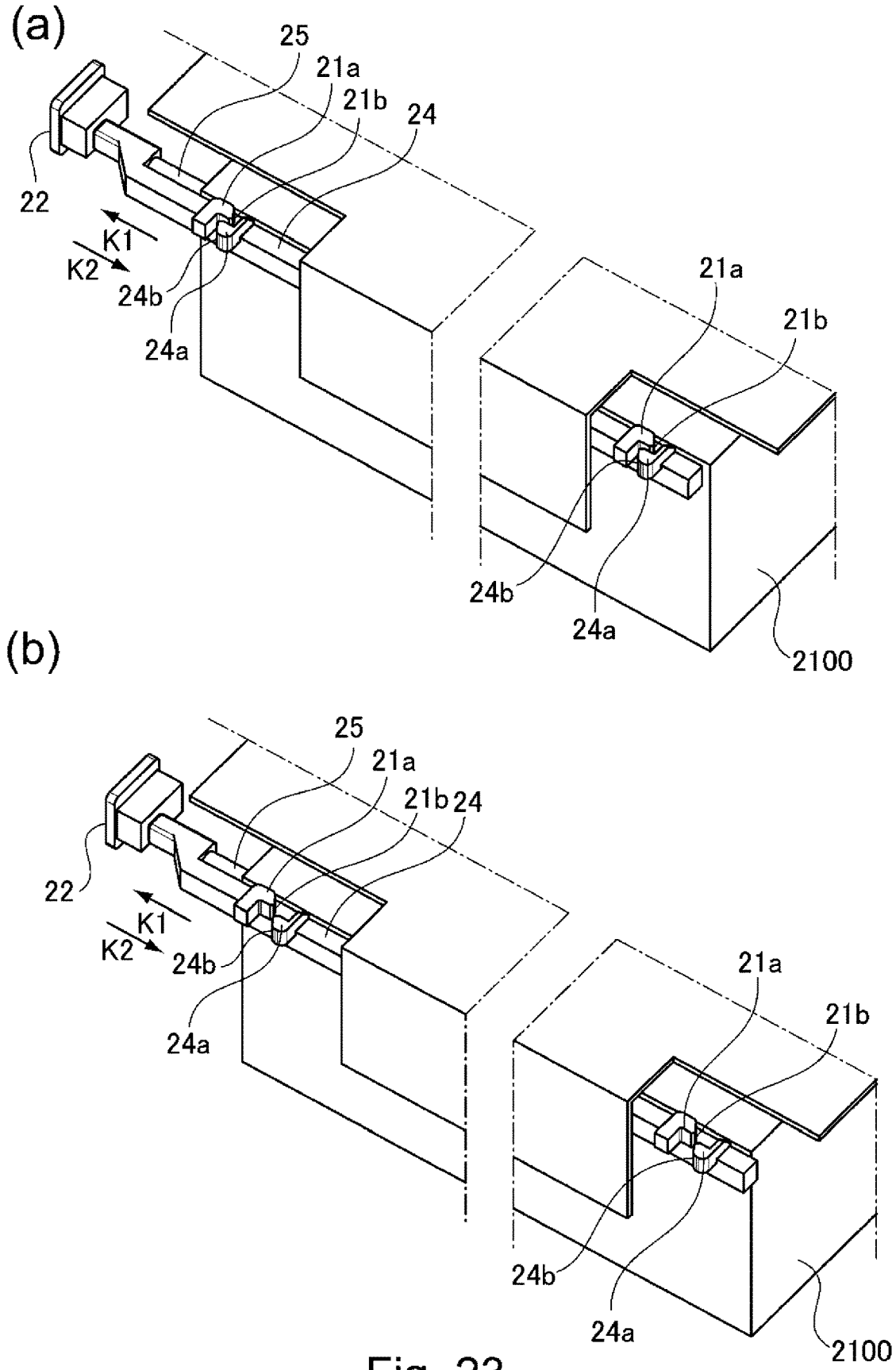

Parts (a) and (b) of FIG. 23 are enlarged perspective views showing a latch member and a periphery thereof in the fourth embodiment.

Figure 24:
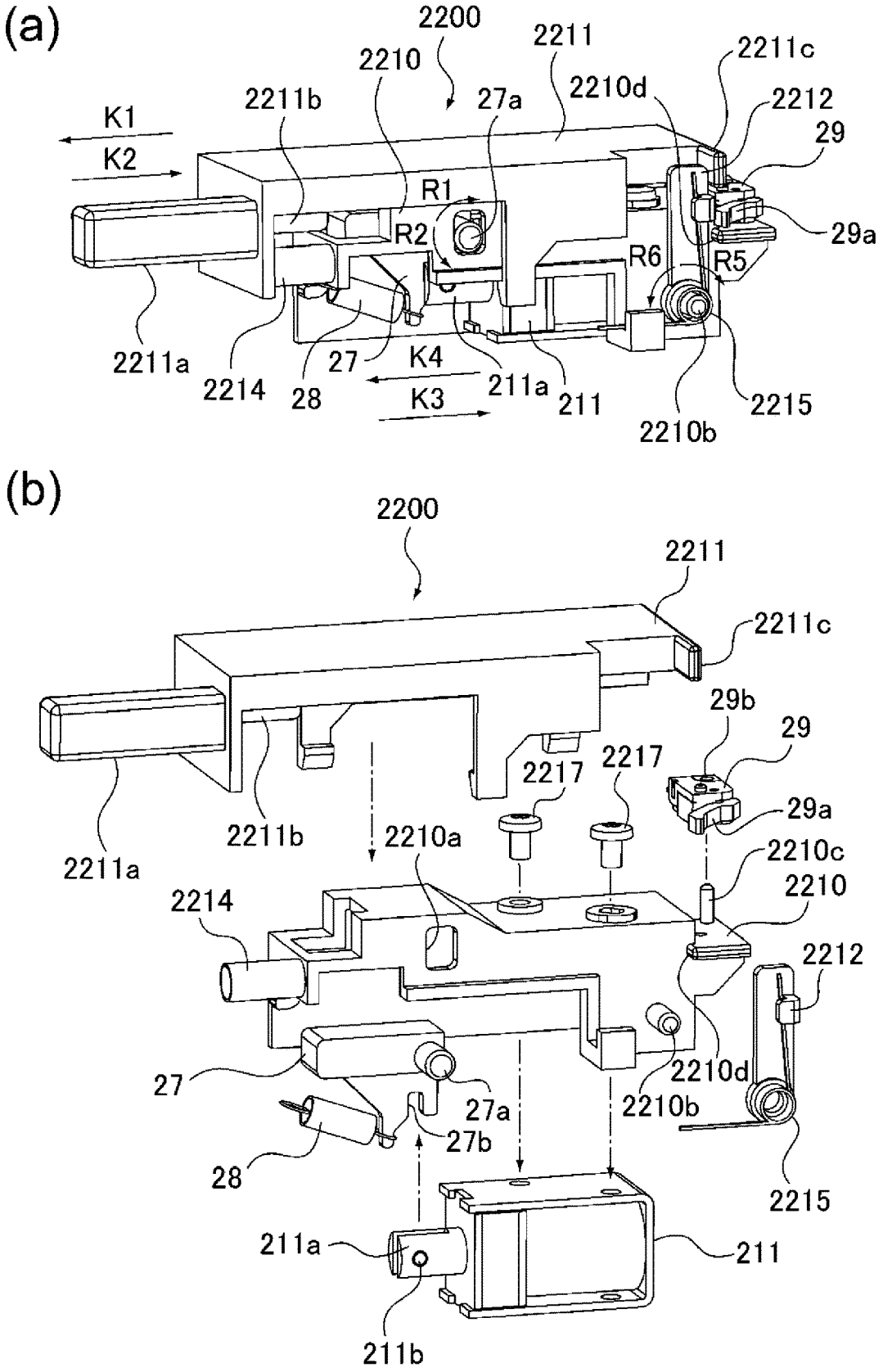

Part (a) of FIG. 24 is a perspective view of a restricting unit in the fourth embodiment, and part (b) of FIG. 24 is an exploded perspective view of the restricting unit.

Figure 25:
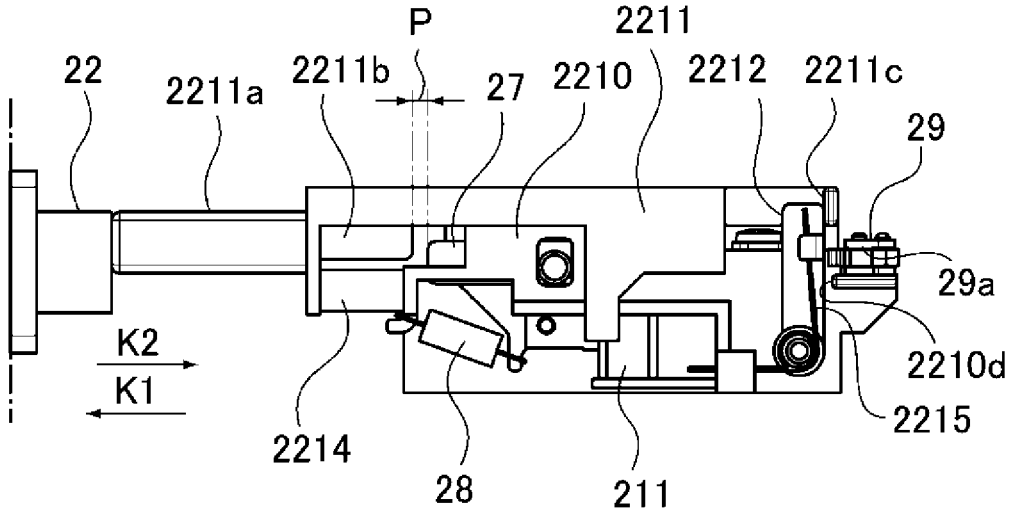
Figure 25:
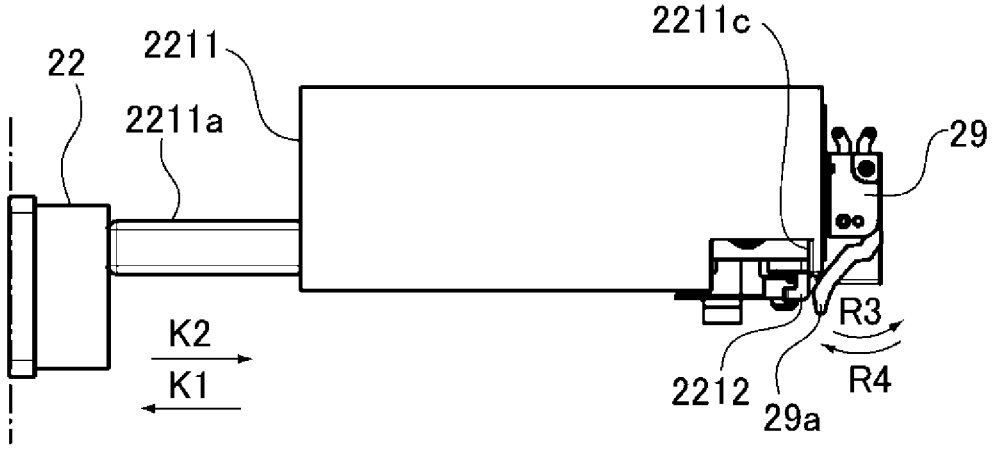

Part (a) of FIG. 25 is a front view of the restricting unit in the fourth embodiment, and part (b) of FIG. 25 is a top (plan) view of the restricting unit.

Figure 26:
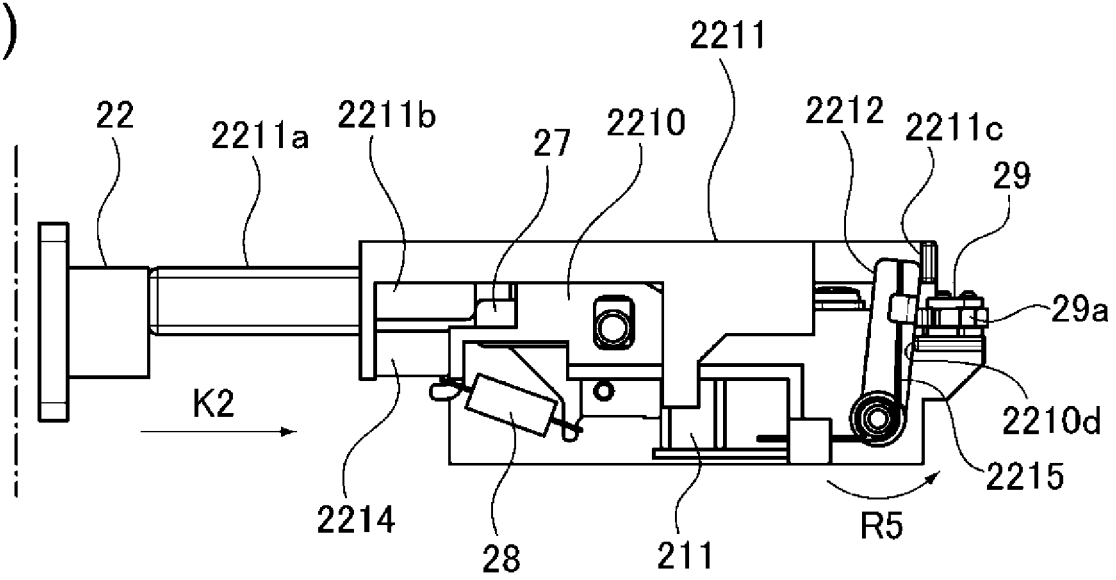
Figure 26:
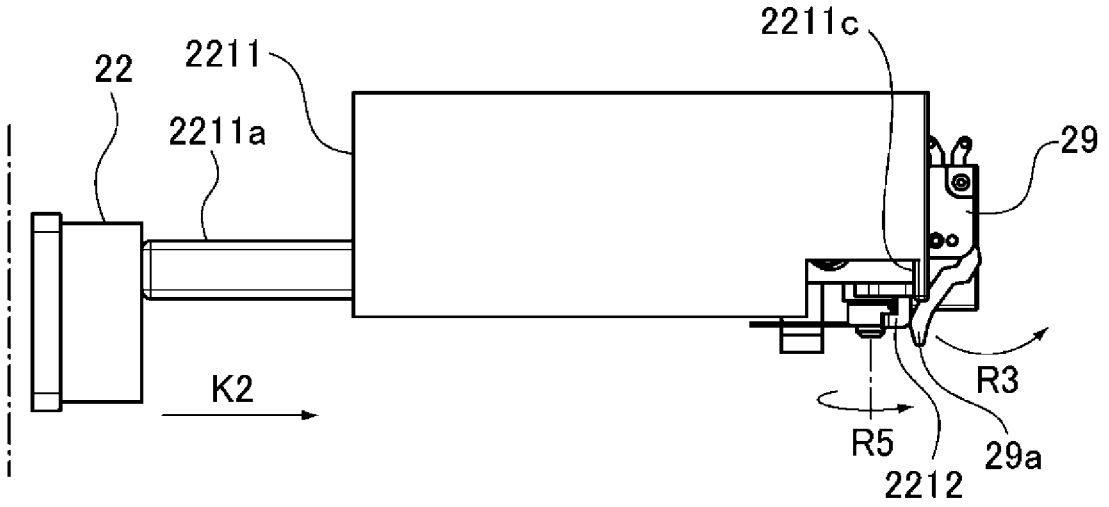

Parts (a) and (b) of FIG. 26 are schematic views of the restricting unit when a stopper member is positioned at a restricted position and a button is pressed in the fourth embodiment, in which part (a) is front view and part (b) is a top view.

Figure 27:
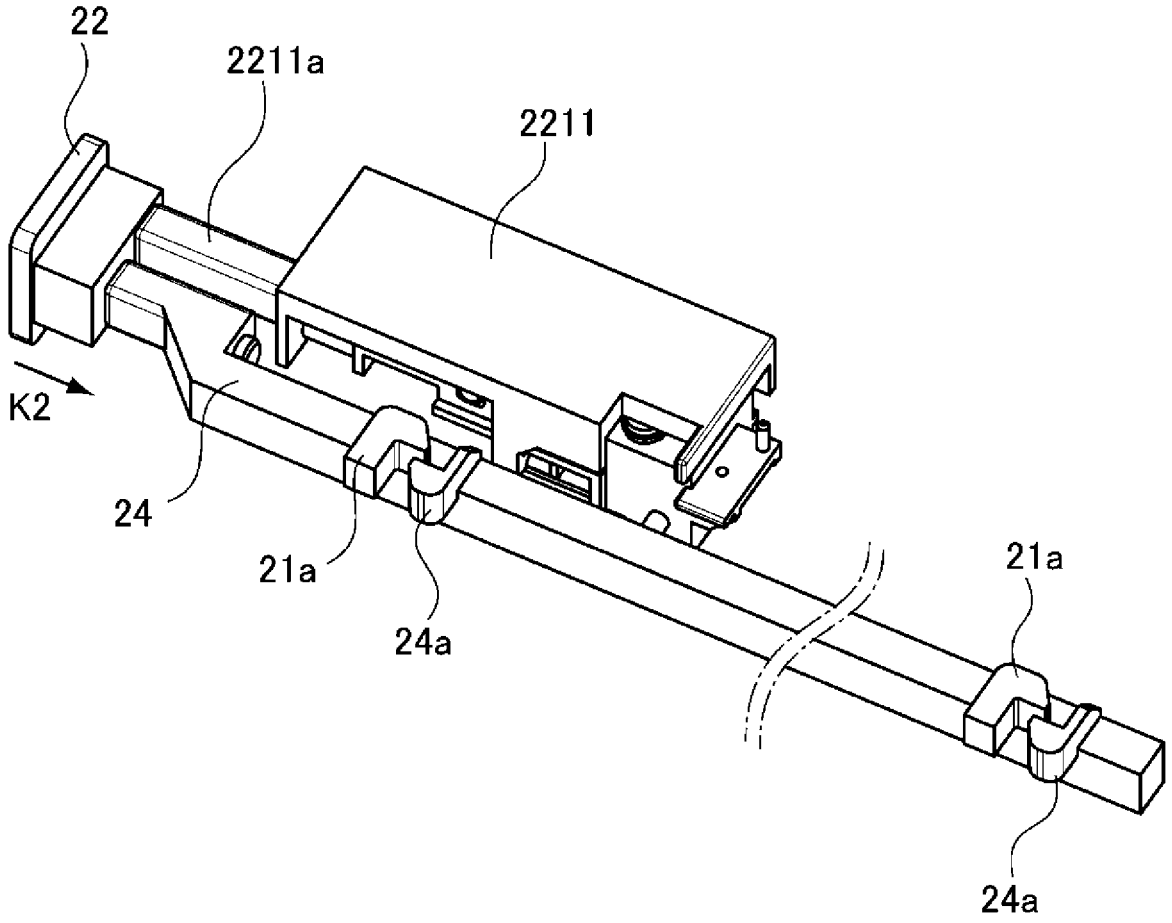

FIG. 27 is a perspective view of the restricting unit and the latch member when the stopper member is positioned at the restricted position and the button is pressed in the fourth embodiment.

Figure 28:
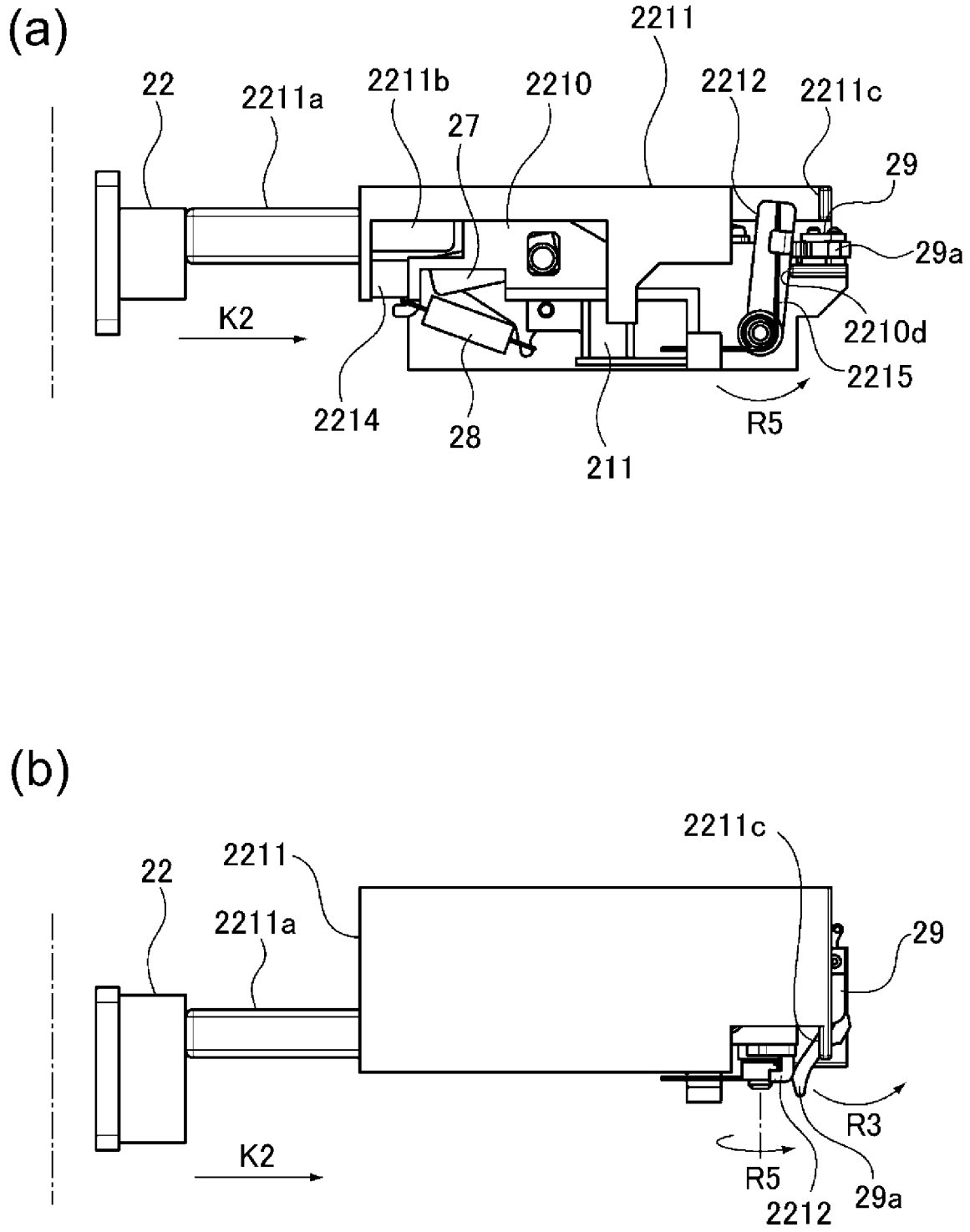

Parts (a) and (b) of FIG. 28 are schematic view of the restricting unit when the stopper member is positioned at a released position and the button is pressed in the fourth embodiment, in which part (a) is a front view and part (b) is a top view.

Figure 29:
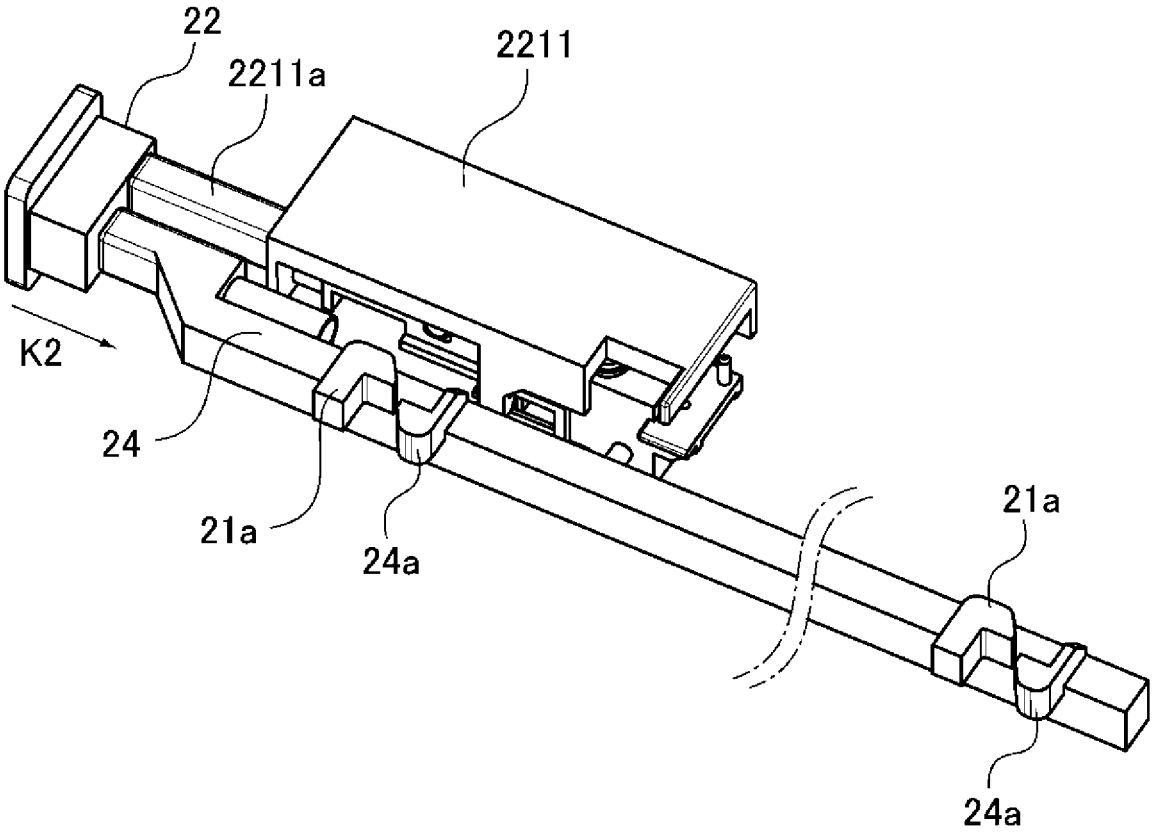

FIG. 29 is a perspective view of the restricting unit and the latch member when the stopper member is positioned at the released position and the button is pressed in the fourth embodiment.

Figure 30:
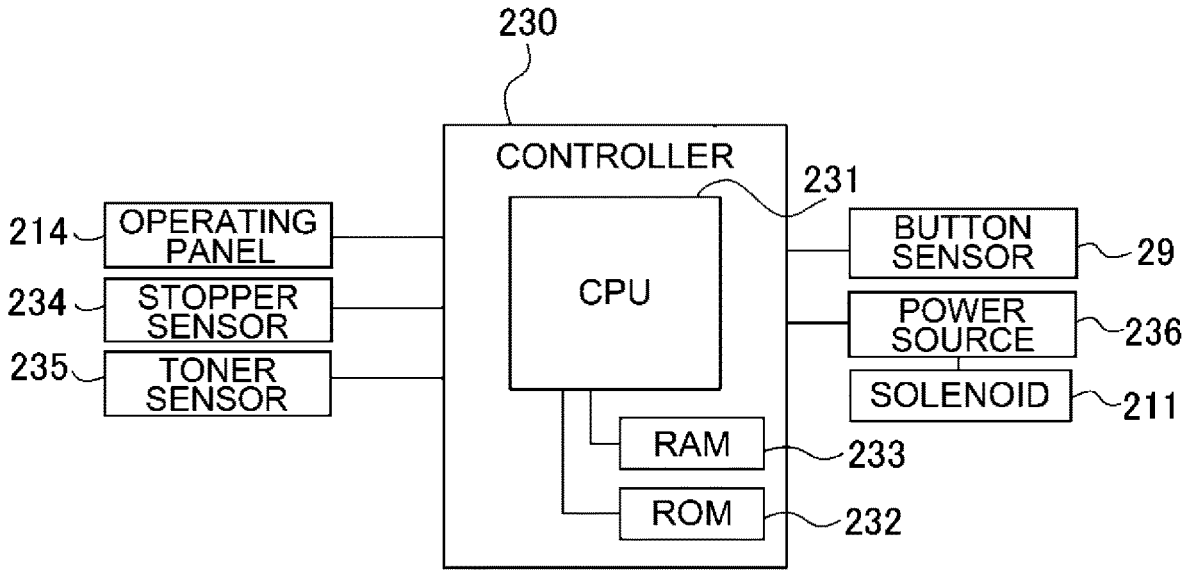

FIG. 30 is a block diagram showing a system constitution of the fourth embodiment.

Figure 31:
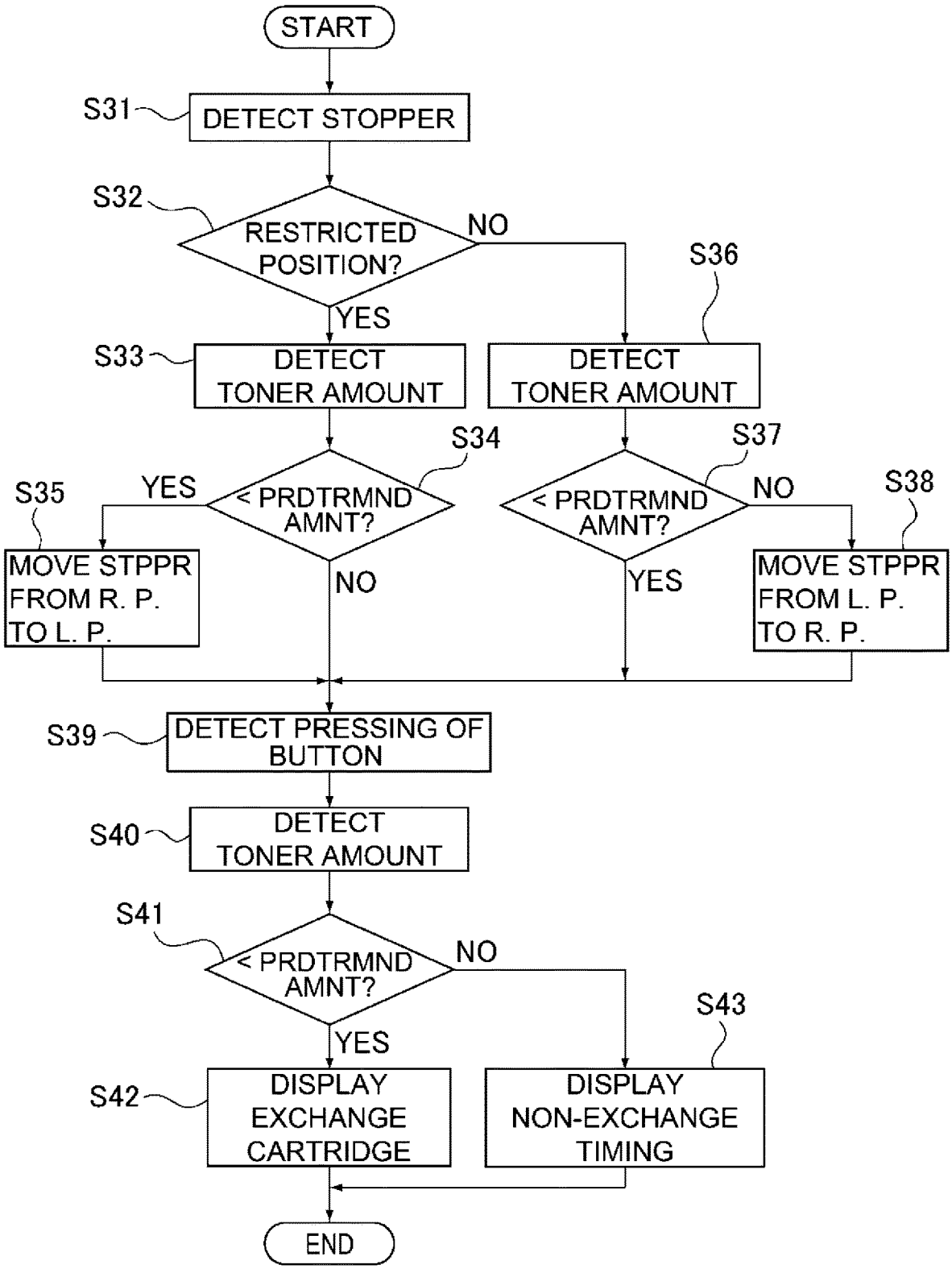

FIG. 31 is a flowchart of a cartridge exchange sequence in the fourth embodiment.

DESCRIPTION OF EMBODIMENTS

In the following, embodiments of the present invention will be described specifically with reference to the drawings. In the following embodiments, constituent elements are examples, and various conditions such as structures, functions, materials, shapes, relative arrangements and the like of an apparatus to which the present invention is applicable can be appropriately modified or changed within a range not deviating from a scope of the present invention, and are not limited to those in the following embodiments. For example, in the following embodiments, as an image forming apparatus, a color laser printer using an electrophotographic image forming process will be described, and the present invention is not limited to the image forming apparatus using the electrophotographic image forming process, but may also be an image forming apparatus of another type such as an ink jet type.

First Embodiment

Figure 1:
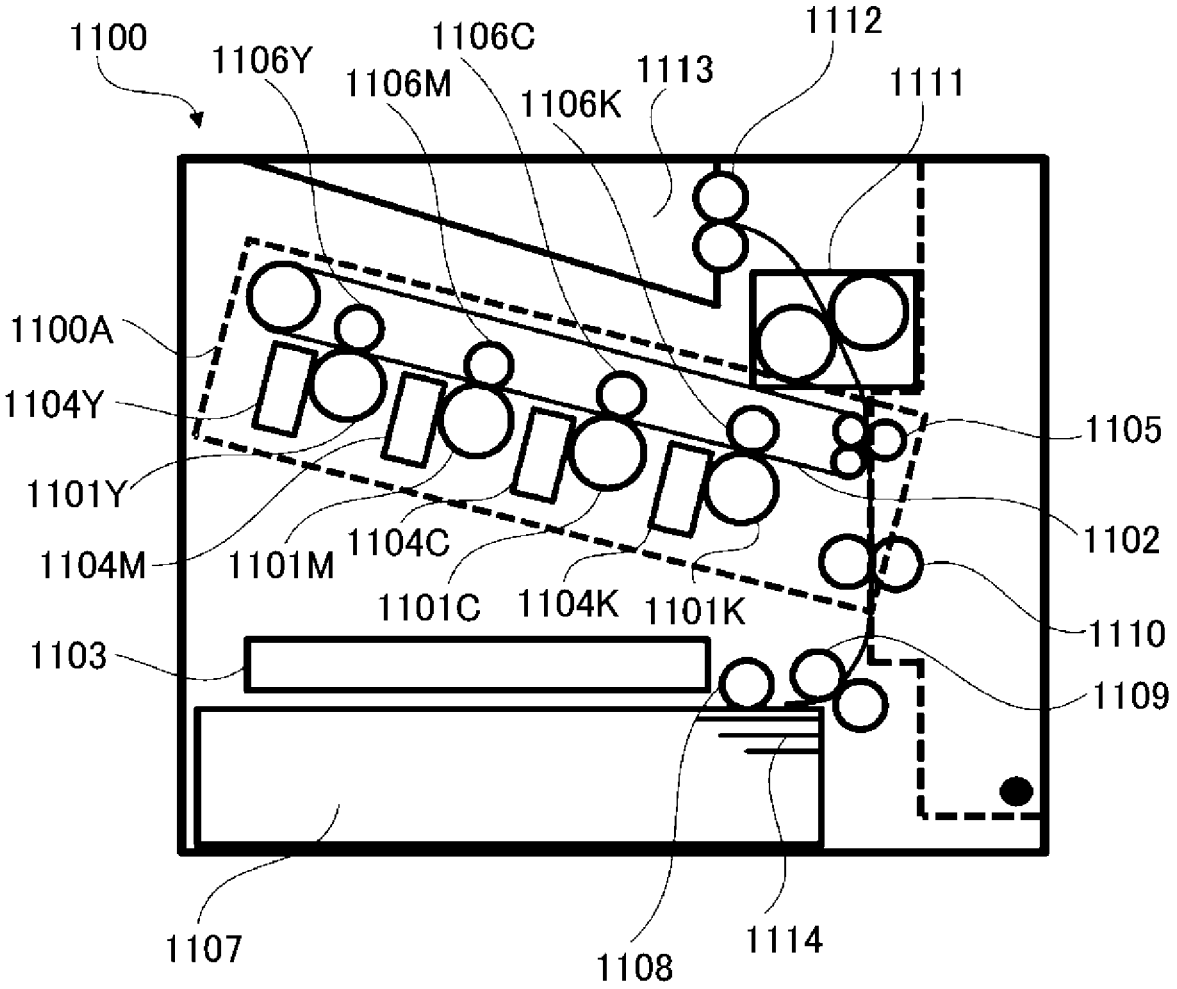
FIG. 1 is a schematic front sectional view of a printer according to a first embodiment.

FIG. 1 is a schematic front sectional view of a color laser printer as an image forming apparatus according to a first embodiment.

In FIG. 1, a printer 1100 includes an image forming portion 1100A for forming images by an electrophotographic process. This image forming portion 1100A includes four photosensitive drums 1101Y, 1101M, 1101C and 1101K for forming toner images of four colors of yellow, magenta, cyan and black, respectively. Further, the image forming portion 1100A includes an endless intermediary transfer belt 1102 which contacts these four photosensitive drums 1101Y, 1101M, 1101C and 1101K and onto which the toner images formed on the photosensitive drums 1101Y, 1101M, 1101C and 1101K are primary-transferred.

The image forming portion 1100A further includes primary transfer rollers 1106Y, 1106M, 1106C and 1106K for forming nips between the intermediary transfer belt 1102 and the respective photosensitive drums 1101Y, 1101M, 1101C and 1101K from an inner peripheral side of the intermediary transfer belt 1106. These primary transfer rollers 1106Y, 1106M, 1106C and 1106K primary-transfer the toner images onto the intermediary transfer belt 1102 by generating a potential difference between the intermediary transfer belt 1102 and the photosensitive drums 1101Y, 1101M, 1101C and 1101K, respectively. Further, the image forming portion 1100A includes a secondary transfer roller 1105 which forms a nip between itself and the intermediary transfer belt 1102 and which secondary-transfers the images from the intermediary transfer belt 1102 onto a sheet 1114 such as a print sheet.

When an image forming operation is started in the image forming portion 1100A, the photosensitive drums 1101Y, 1101M, 1101C and 1101K are irradiated with beams (light) depending on image signals by a laser scanner 1103, so that latent images are formed on the photosensitive drums 1101Y, 1101M, 1101C and 1101K.

Next, the latent images are developed with toners accommodated in developing cartridges (developer cartridges) 1104Y, 1104M, 1104C and 1104K each including a developing roller, so that toner images (visible images) are formed on the photosensitive drums 1101Y, 1101M, 1101C and 1101K.

The toner images formed on the photosensitive drums 1101Y, 1101M, 1101C and 1101K are primary-transferred onto the intermediary transfer belt 1102, and the toner images primary-transferred onto the intermediary transfer belt 1102 are fed to a secondary transfer portion by the intermediary transfer belt 1102.

In parallel with the above-described toner image forming operation, sheets 1114 are fed one by one from a sheet accommodating portion 1107 by a pick-up roller 1108. Then, the sheet 1114 is fed to the secondary transfer portion, formed by the nip between the intermediary transfer belt 1102 and the secondary transfer roller 1105, by a feed roller 1109 and a registration roller 1110 for correcting oblique movement of the sheet 1114.

Here, the sheet 1114 is required to align a position thereof, with respect to a sheet feeding direction, with the toner images formed on the intermediary transfer belt 1102. For that reason, feeding speed control of the sheet is carried out by the registration roller 1110 and the feed roller 1109, so that a feeding operation of the sheet 1114 is timed to the toner images formed on the intermediary transfer belt 1102. Then, by applying a bias to the secondary transfer roller 1105 at the secondary transfer portion, the toner images are transferred from the intermediary transfer belt 1102 onto the sheet 1114.

The sheet 1114 on which the toner images are transferred is fed to a fixing portion 1111, and is heated and pressed in the fixing portion 1111, so that the toner images are fixed on the sheet 1114 and the sheet 1114 is discharged onto a discharge portion 1113 at an upper portion of the printer 1100 by a discharging roller 1112.

The photosensitive drums 1101Y, 1101M, 1101C and 1101K and the developing cartridges 1104Y, 1104M, 1104C and 1104K are consumables, and therefore, are constituted so as to be mountable in and dismountable from a mounting portion of the printer 1100. Further, the developing cartridges 1104Y, 1104M, 1104C and 1104K are provided with known remaining toner amount detecting sensors, respectively, so that remaining toner amounts in the respective developing cartridges are monitored.

Figure 2:
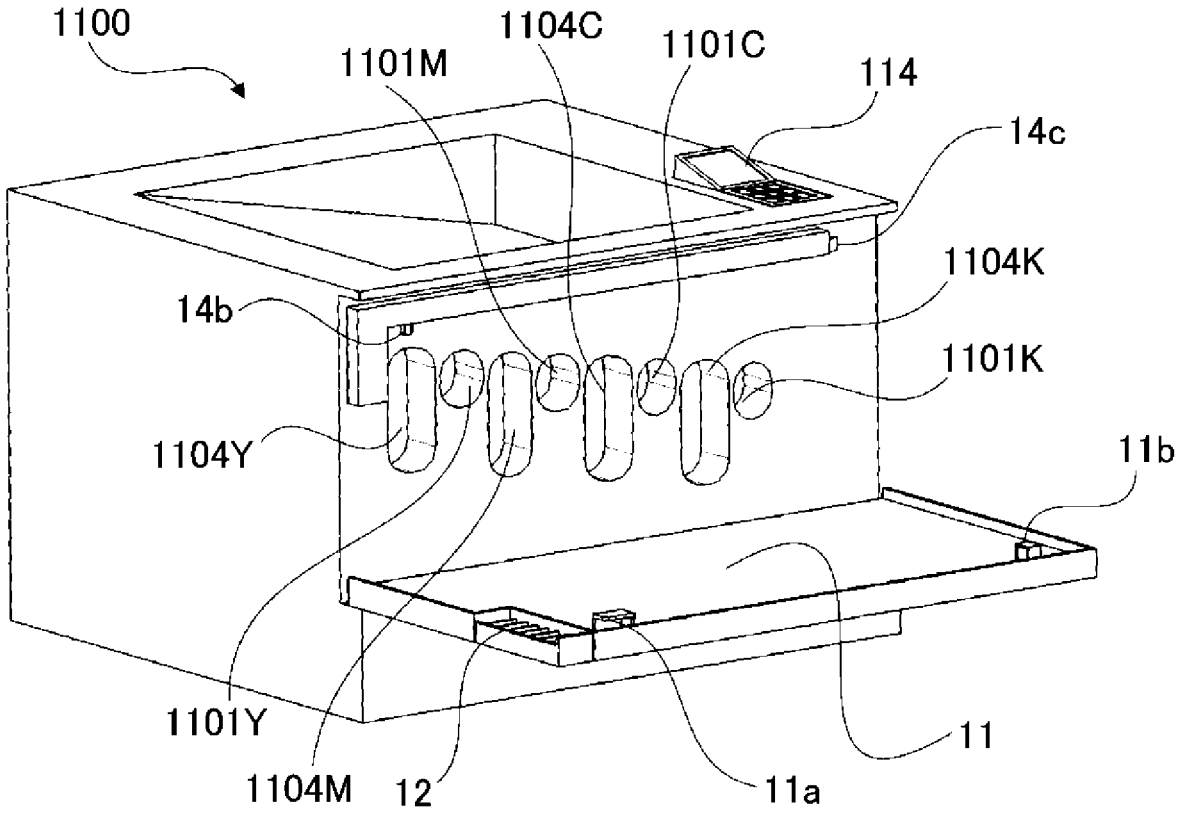
FIG. 2 is a perspective view of the printer according to the first embodiment.

FIG. 2 is a perspective view showing a state in which an openable cover 11, of the printer 1100, for permitting exchange of the photosensitive drums 1101Y, 1101M, 1101C and 1101K and the developing cartridges 1104Y, 1104M, 1104C and 1104K is open.

In FIG. 2, the photosensitive drums 1101Y, 1101M, 1101C and 1101K and the developing cartridges 1104Y, 1104M, 1104C and 1104K are mountable and dismountable in a direction, in which the openable cover 11 is open, by opening the openable cover 11 covering the mounting portion therefor.

In a state in which the openable cover 11 is closed, the openable cover 11 is kept in the closed state by locking latch locking portions 11*a* and 11*b* of the openable cover 11 by latch portions 14*b* and 14*c*, respectively, as holding portions provided on a main assembly of the printer 1100.

An operating portion 12 is an operating portion for releasing lock (locking) of the latch locking portions 11*a* and 11*b* of the openable cover 11, and is a lever to be pulled frontward when the openable cover 11 is opened. When the operating portion 12 is pulled frontward, the latch portions 14*b* and 14*c* slide (move) in interrelation with each other and release the lock of the latch locking portions 11*a* and 11*b* of the openable cover 11, so that the openable cover 11 is in an open state.

An operation panel 114 is a user interface, of the printer 1100, for performing various displays and operation input.

Parts (a) and (b) of FIG. 3 illustrate a mechanism for releasing the lock of the latch locking portions 11*a* and 11*b* of the openable cover 11 by the latch portions 14*b* and 14*c* when the operating portion 12 of FIG. 12 is pulled frontward. Part (a) of FIG. 3 is a perspective view of a principal part showing a state in which the latch portions 14*b* and 14*c* lock the latch locking portions 11*a* and 11*b* of the openable cover 11, and part (b) of FIG. 3 is a perspective view of a principal part showing a state in which the latch portions 14*b* and 14*c* release the lock of the latch locking portions 11*a* and 11*b* of the openable cover 11.

In parts (a) and (b) of FIG. 3, a latch 14 is constituted by a lock shaft 14*a*, the latch portion 14*b* and the latch portion 14*c*, and these portions move integrally with each other. A latch spring 15 urges the latch 14 in an arrow R direction in which the latch portions 14*b* and 14*c* lock the latch locking portions 11*a* and 11*b* of the openable cover 11.

When a handgrip portion 12*a* of the operating portion 12 is pulled in an arrow D direction as shown in part (b) of FIG. 3 from a state shown in part (a) of FIG. 3 in which the latch 14 locks the latch locking portions 11*a* and 11*b* of the openable cover 11, the operating portion 12 is rotated about an operation rotation shaft 12*b* in the arrow D direction. As an operating portion end 12*c* pushes a first arm 16*b* of a connecting member 16 constituting a movable portion shown in part (a) of FIG. 3, so that the connecting member 16 is rotated about a rotation shaft 40 in an arrow E direction.

By this rotation, a second arm 16*c* of the connecting member 16 pushes a portion-to-be-urged 14*d* of the latch 14 in an arrow L direction against an urging force of the latch spring 15. When the connecting member 16 is rotated (moved) in the arrow E direction to a predetermined position, the latch 14 slides (moves) to a lock releasing position where the latch portions 14*b* and 14*c* release the lock of the latch locking portions 11*a* and 11*b* of the openable cover 11. As a result, the openable cover 11 opens in an arrow F direction.

Parts (a) and (b) of FIG. 4 illustrate a driving portion of a locking mechanism for locking the openable cover 11 in the closed state by disabling release of the lock of the latch locking portions 11*a* and 11*b* of the openable cover 11 by the latch portions 14*b* and 14*c*. Part (a) of FIG. 4 is a sectional view showing a locked state of the driving portion of the locking mechanism, and part (b) of FIG. 4 is a sectional view showing a lock-released state of the driving portion of the locking mechanism.

In parts (a) and (b) of FIG. 4, a lock lever 17 constituting a locking portion and a restricting portion is held rotatably about a rotation shaft 141, and one end thereof is pulled in an arrow G direction by a locking spring 18 as an urging member, so that the lock lever 17 is rotated in an arrow H direction. On the other hand, a constitution in which the other end of the lock lever 17 is pulled in an arrow J direction by a solenoid 111 constituting an electric driving portion and thus is rotated in an arrow K direction is employed. Then, depending on a balance of magnitude between an urging force of the locking spring 18 and an attraction force of the solenoid 111, position control of a locked position and a lock-released position is carried out, and the locking mechanism is constituted by these members.

Pulling of the lock lever 17 in the arrow J direction by the solenoid 111 is performed by pulling of the lock lever 17 through a spring pin 111*b* by a plunger 111*a* pulled by a magnetic force of the solenoid 111.

In the locked state shown in part (a) of FIG. 4, a force relationship between the urging force of the locking spring 18 and the attraction force based on the magnetic force of the solenoid 111 is "(urging force of locking spring 18)>(attraction force of solenoid 111)". As a result, the lock lever 17 is pulled in the arrow J direction and is rotated in the arrow H direction, so that the locked position is determined at a position where the lock lever 17 abuts against a rotation stopper 16.

In the lock-released state shown in part (b) of FIG. 4, when the magnetic force is strengthened by input of attraction instruction to the solenoid 111, the force relationship between the urging force of the locking spring 18 and the attraction force based on the magnetic force of the solenoid 111 is "(urging force of locking spring 18)<(attraction force of solenoid 111)". As a result, the plunger 111*a* is pressed down in the arrow J direction, and the lock lever 17 is pulled by the plunger 111*a* and is rotated in the arrow K direction, so that the lock lever 17 is moved to the lock-released position.

Parts (a) and (b) of FIG. 5 illustrate a locking operation of the locking mechanism for locking the openable cover 11 in the closed state. Part (a) of FIG. 5 is a sectional view showing a state before the openable cover 11 is opened by the operating portion 12, and part (b) of FIG. 5 is a sectional view showing a state when the openable cover 11 is opened by the operating portion 12.

When the locking mechanism is in the locked state and the operating portion 12 is operated for opening the openable cover 11 as described with reference to FIG. 3, the connecting member 16 is rotated in the arrow E direction in interrelation with the operation of the operating portion 12, so that the connecting member 16 is moved from a position of part (a) of FIG. 5 to a position of part (b) of FIG. 5.

In a state of part (b) of FIG. 5, as described above, the lock lever 17 is rotated in the arrow H direction by the locking spring 18, and therefore, the lock lever 17 abuts against an abutment surface 16*a* of the connecting member 16, so that rotation movement of the connecting member 16 is restricted. In the state of part (b) of FIG. 5, the second arm 16*c* of the connecting member 16 is in a position in front of a position where the second arm 16*c* urges the portion-to-be-urged 14*d* of the latch 14, and therefore, the latch 14 cannot slide (move) to the lock-released position where the lock of the latch locking portions 11*a* and 11*b* of the openable cover 11 is released by the latch portions 14*b* and

14*c*. That is, the lock of the openable cover 11 cannot be released, and therefore, the openable cover 11 is not opened.

Parts (a) and (b) of FIG. 6 illustrate a lock-releasing operation of the locking mechanism for locking the openable cover 11 in the closed state. Part (a) of FIG. 6 is a sectional view showing a state before the openable cover 11 is opened by the operating portion 12, and part (b) of FIG. 6 is a sectional view showing a state when the openable cover 11 is opened by the operating portion 12.

When the locking mechanism is in the lock-released state and the operating portion 12 is operated for opening the openable cover 11 as described with reference to FIG. 3, the connecting member 16 is rotated in the arrow E direction in interrelation with the operation of the operating portion 12, so that the connecting member 16 is moved from a position of part (a) of FIG. 5 to a position of part (b) of FIG. 6.

In a state of part (b) of FIG. 6, as described above, the lock lever 17 is rotated in the arrow K direction by the attraction force of the solenoid 111, and therefore, the lock lever 17 is retracted from a restricting position where the lock lever 17 abuts against the abutment surface 16*a* of the connecting member 16, so that the rotation movement of the connecting member 16 is not restricted. Therefore, the second arm 16*c* of the connecting member 16 can urge the portion-to-be-urged 14*d* of the latch 14, and therefore, the latch 14 can slide (move) to the lock-released position, so that the latch portions 14*b* and 14*c* can release the lock of the latch locking portions 11*a* and 11*b* of the openable cover 11. That is, the lock of the openable cover 11 can be released, and therefore, the openable cover 11 is opened.

Parts (a) to (d) of FIG. 7 illustrate an operation detecting mechanism, in which part (a) is a perspective view showing an entirety of the operation detecting mechanism including the locking mechanism, and parts (b), (c) and (d) are perspective views showing a principal part of the operation detecting mechanism.

In parts (a) to (d) of FIG. 7, a switch lever 110 for pressing an operation detection switch 19 for detecting that the operating portion 12 was operated is held rotatably about a rotation shaft 41 which is coaxial with the lock lever 17, and engages with a third arm 6*d* of the connecting member 16 at an engaging surface 16*a*.

In a state in which the operating portion 12 is not operated, as shown in part (b) of FIG. 7, the switch lever 110 does not press the operation detection switch 19.

A state of part (c) of FIG. 7 is a state of the switch lever 110 when the operating portion 12 is operated in the locked state in which the openable cover 11 is locked in the closed state and thus the switch lever 110 is in a state corresponding to part (b) of FIG. 5. An engaging surface 110*a* of the switch lever 110 is pressed by the rotated third arm 16*d* of the connecting member 16, so that the operation detection switch 19 is pressed by the switch lever 110. When the operation detection switch 19 is pressed to an ON position, a signal thereof is sent to a control circuit described later, and operation of the operating portion 12 is detected.

A state of part (d) of FIG. 7 is a state of the switch lever 110 when the operating portion 12 is operated in the lock-released state in which the lock of the openable cover 11 in the closed state is released and thus the switch lever 110 is in a state corresponding to part (b) of FIG. 6. The rotation position of the connecting member 16 moves from the state of part (c) of FIG. 7 to a further advanced position, and therefore, an engaging position of the arm 6*d* with the switch lever 110 moves from the engaging surface 110*a* to an engaging surface 110*b*. The engaging surface 110*b* has an arcuate shape concentric with the rotation shaft 140 and contacts the third arm 6*d*, and therefore, even when a rotation amount of the connecting member 16 increases, a pressing amount of the operation detection switch 19 by the switch lever 110 is constant.

Thus, the switch lever 110 is capable of detecting the operation of the operating portion 2 when the operating portion 2 is operated, irrespective of the locked state of the locking mechanism in which the openable cover 11 is locked in the closed state, and the lock-released state of the locking mechanism.

Incidentally, when control of the lock and lock-release of the locking mechanism for locking the openable cover 11 in the closed state is carried out as shown in FIGS. 5 to 7, the solenoid 111 is controlled by generating a magnetic field under application of a current for operating the plunger 111*a*. However, there is a liability that in the case where a patient using a pacemaker is in the neighborhood of the printer 1100, the generation of the magnetic field causes an erroneous operation or the like, and therefore, is not preferred in some cases. For that reason, the solenoid 111 is covered with a solenoid holding metal plate shown in part (a) of FIG. 7 so that a projected cross-section including an operation region of the plunger 111*a* is completely covered, and therefore, magnetic radiation is shielded.

FIG. 8 is a circuit block diagram showing a control constitution in this embodiment.

In FIG. 8, a control circuit 1101 as a controller is constituted by a CPU for controlling an entirety of a circuit, and an operation detecting circuit 1202 detects that the operating portion 12 is operated and thus the operation detection switch 19 is turned on. An openable cover closing detecting portion 1203 as a closing detecting portion detects that the openable cover 11 is closed, and a display driving circuit 1204 is provided for driving an operation panel 114 of FIG. 2. The circuit further includes a remaining toner amount detecting circuit 1205 as a determining portion for detecting (determining) remaining toner amounts of the developing cartridges 1104Y, 104M, 1104C and 1104K by remaining toner amount detecting sensors, and includes a detecting circuit 1206 for the solenoid 111.

Next, an operation of the locking mechanism for the openable cover 11 will be described in accordance with a flowchart, of the control circuit 201 of FIG. 8, shown in FIG. 9.

In a step S01, when a decrease in remaining toner amounts of the developing cartridges 1104Y, 1104M, 1104C and 1104K to a predetermined amount or less is detected by the remaining toner amount detecting circuit 205, the control circuit 1201 receives a signal thereof, and a sequence goes to a step S02. That is, when determination that the developing cartridge is in a state in which the developing cartridge is to be exchanged is made by the remaining toner amount detecting circuit 1205, the control circuit 1202 receives the signal thereof, and the sequence goes to the step S02.

In the step S02, when the control circuit 1201 receives the signal indicating that determination that the developing cartridge is in the state in which the developing cartridge is to be exchanged is made, the control circuit 1201 sends a signal, for driving the solenoid 111, to the solenoid driving circuit 1206. As a result, the solenoid driving circuit 1206 drives the solenoid 111 and the lock lever 17 is pulled, so that lock retention by which the openable cover 11 is kept in the closed state is made releasable.

Thereafter, in a step S03, the developing cartridge is exchanged with a new (fresh) cartridge, and closing of the openable cover 11 is detected by the openable cover closing detecting circuit 1203. Then, in a step S04, when detection that the remaining toner amounts of the developing cartridges 1104Y, 1104M, 1104C and 1104K are not the predetermined amount or less is made by the remaining toner amount detecting circuit 1205, in a step S05, drive of the solenoid 111 by the solenoid driving circuit 1206 is stopped. As a result, the lock lever 17 is pulled by the locking spring 18, so that the lock retention by which the openable cover 11 is kept in the closed state is made unreleasable.

On the other hand, in the step S01, when determination that the remaining toner amounts of the developing cartridges 1104Y, 1104M, 1104C and 1104K are not the predetermined amount or less and thus the developing cartridges are not yet in a state in which the process cartridges should not be exchanged is made by the remaining toner amount detecting circuit 1205, the sequence goes to a step S06. In the step S06, drive of the solenoid 111 is not carried out, the lock retention by which the openable cover 11 is kept in the closed state is not made releasable. Therefore, a user cannot open the openable cover 11, and therefore, exchange of the developing cartridge is not performed, so that it is possible to prevent early exchange of the developing cartridge which is still usable.

Next, a display operation of the operation panel 114 when the operating portion 12 is operated by the user for opening the openable cover 11 will be described in accordance with a flowchart, of the control circuit 1201 of FIG. 8, shown in FIG. 10.

In a step S011, when the operation of the operating portion 12 by the user for opening the openable cover 11 is detected by the operation detecting circuit 1202 through turning-on of the operation detection switch 19, a sequence goes to a step S12. In the step S12, whether or not the remaining toner amounts of the developing cartridges 1104Y, 1104M, 1104C and 1104K decrease to a predetermined amount or less is detected by the remaining toner amount detecting circuit 1205.

When determination that the remaining toner amounts of the developing cartridges 1104Y, 1104M, 1104C and 1104K decrease to the predetermined amount or less and thus the developing cartridges are in a state in which the developing cartridges are to be exchanged is made by the remaining toner amount detecting circuit 1205, the sequence goes to a step S13. In the step S13, in response to the determination that the developing cartridges are in the state in which the developing cartridges are to be exchanged is made, the display driving circuit 1204 causes the operation panel 114 to produce display corresponding to the state in which the developing cartridges are in the state in which the developing cartridges are to be exchanged. Specifically, guidance such that the lock of the openable cover 11 is released and the developing cartridge can be exchanged and guidance of an instruction necessary for the exchange and of an exchanging method are carried out visually or by voice through the operation panel 114.

On the other hand, in the step S12, when the determination that the remaining toner amounts of the developing cartridges 1104Y, 1104M, 1104C and 1104K do not decrease to the predetermined amount or less and thus the developing cartridges are not yet in the state in which the developing cartridges are to be exchanged is made by the remaining toner amount detecting circuit 1205, the sequence goes to a step S14.

In the step S14, in response to the determination that the developing cartridges are not yet in the state in which the developing cartridges are to be exchanged is made, the display driving circuit 1204 causes the operation panel 114 to produce display corresponding to the state in which the developing cartridges are not in the state in which the developing cartridges are to be exchanged. Specifically, guidance such that the developing cartridges are still usable and therefore this timing is not exchange timing and that the lock of the openable cover 11 is unreleased is carried out visually or by voice through the operation panel 114.

Incidentally, the display, depending on whether or not the retention of the closed state of the openable cover 11 is releasable, produced by the operation panel may also be display other than the above-described displays.

Parts (a) and (b) of FIG. 11 illustrate a constitution in which in the case where an electrical component part for driving the solenoid 111 is out of order and release of the locking mechanism locking the openable cover 11 in the closed state cannot be carried out, manual lock release is performed urgently. Part (a) of FIG. 11 is a perspective view of an outer appearance of the printer 1100, and part (b) of FIG. 11 is a perspective view of a principal part of the printer 1100.

In part (b) of FIG. 11, in the locked state of the locking mechanism for locking the openable cover 11, as described above, a rotation region of the connecting member 16 is restricted by the lock lever 17, so that the lock retention of the openable cover 11 cannot be released. Accordingly, when the electrical component part is out of order and the restriction of the rotation region of the connecting member 16 by the lock lever 17 cannot be released, the openable cover 11 cannot be opened. However, an operation itself of the latch 14 is not constrained, and therefore, a latch releasing portion 115 provided on the latch 14 is pressed in the arrow L direction by a tool 131, whereby the latch 14 is slid (moved) and the lock retention of the openable cover 11 is released, so that the openable cover 11 can be opened.

At this time, as shown in part (a) of FIG. 11, the tool 131 is inserted into an upper portion gap of the openable cover 11 in the printer 1100, and then the latch releasing portion 115 is pressed in the arrow L direction by the tool 131, so that release of the lock retention of the openable cover 11 is carried out.

Second Embodiment

Next, a second embodiment will be described. Incidentally, a basic constitution is the same as the first embodiment, and a redundant portion will be omitted from description. Further, constituent elements having the same functions as those in the first embodiment are represented by the same reference numerals or symbols and will be appropriately omitted from description.

FIG. 12 is a perspective view showing a state in which an openable cover 11 of a printer 1100 for permitting exchange of photosensitive drums 1101Y, 1101M, 1101C and 1101K and developing cartridges 1104Y, 1104M, 1104*c* and 1104K according to the second embodiment is opened. Parts (a) and (b) of FIG. 13 are sectional views taken along A-A line of FIG. 12. Part (a) of FIG. 13 shows a state before the openable cover 11 placed in a lock-released state in which a locking mechanism for locking the openable cover 11 in a closed state is lock-released is opened, and part (b) of FIG. 13 shows a state when the openable cover 11 placed in the lock-released state is opened.

In FIG. 12 and part (b) of FIG. 13, a cover button 132 as an operating portion for performing a lock-releasing operation of latch locking portions 11*a* and 11*b* of the openable cover 11 is used for placing the openable cover 11 in an open state by being urged in an arrow M direction by a user.

In parts (a) and (b) of FIG. 13, a locking and lock-releasing mechanism for the latch locking portions 11*a* and 11*b* of the openable cover 11 includes a first link 120 constituting a second moving portion and a second link 121 constituting a first moving portion. The locking and lock-releasing mechanism further includes a link spring 122 provided between the first link 120 and the second link 121, a latch 14, a latch holder 123, and a latch spring 15 provided between the latch 14 and the latch holder 123.

The first link 120, the second link 121 and the latch 14 are slidably mounted on the latch holder 123. The latch 14 is positioned by abutment of a contact portion 14*e* thereof against an abutment portion 123*a* of the latch holder 23 by an urging force of the latch spring 15. The second link 121 and the first link 120 are positioned by positioning of the latch 14.

FIG. 15 is an exploded perspective view of a principal part, in which the first link 120, the second link 121, the latch 14 and the latch holder 123 are extracted.

In FIG. 15, the latch 14 is slidably mounted on the latch holder 123 by engagement of holes 14*g* and 14*h*, provided in the latch 14, with bosses 123*j* and 123*k* provided on the latch holder 123. The second link 121 is slidably mounted on the latch holder 123 by engagement of holes 123*b* and 123*c*, provided in the latch holder 123, with bosses 121*b* and 121*c* provided on the second link 121. Further, the second link 121 has a constitution in which an abutment portion 121*a* of the second link 121 is urged by an urging portion 14*f* of the latch 14 by an urging force of the latch spring 15, and thus latch portions 14*b* and 14*c* move to positions of states in which the latch portions 14*b* and 14*c* lock the latch locking portions 11*a* and 11*b*.

The first link 120 is slidably mounted on the latch holder 123 by engagement of an unshown groove portion, provided on the first link 120, with a boss 123*d* provided on the latch holder 123.

FIG. 16 is an enlarged exploded perspective view of a principal part, in which the first link 120 and the second link 121 are extracted.

As shown in FIG. 16, the first link 120 is urged in a direction in which the first link 120 and the second link 121 are separated from each other by a link spring 122 provided between the first link 120 and the second link 121, and a hook portion 120*a* of the first link 120 abuts against an abutment surface portion 121*d* of a hole of the second link 121.

The link spring 122 provided between the first link 120 and the second link 121 and the latch spring 15 provide a force relationship of "(urging force of link spring 122)> (urging force of latch spring 15)". For this reason, when the cover button 132 is pressed down, the first link 120 engaging with the cover button 132 is moved, and the second link 121 is moved by the urging force of the link spring 122, so that the latch 14 is also moved. That is, the link spring 122 transmits an operation of the first link 120 to the second link 121 when the cover button 132 is pressed down, and brings the first link 120 into contact with the second link 121 when the cover button 132 is not pressed down.

Next, an operation of the latch locking portions 11*a* and 11*b* of the openable cover 11 during release of the lock retention will be described.

In FIG. 12 and part (b) of FIG. 13, when the user presses down the cover button 132, as shown in part (b) of FIG. 13, the first link 120 engaging with the cover button 132 slides (moves) in an arrow L direction. Then, the second link 121 slides (moves) in the arrow L direction through the urging force of the link spring 122 provided between the first link 120 and the second link 121. As a result, the latch 14 engaging with the second link 121 slides (moves) in the arrow L direction. By slide (movement) of the second link 121 to a predetermined position, the latch portions 14*b* and 14*c* of the latch 14 release the lock of the latch locking portions 11*a* and 11*b* of the openable cover 11, so that the openable cover 11 is opened.

Next, an operation of the latch locking portions 11*a* and 11*b* of the openable cover 11 during the lock retention will be described.

By the urging force of the latch spring 15 provided between the latch 14 and the latch holder 123 on which the latch 14 is mounted, the latch 14 and the first and second links 120 and 121 move in a direction opposite to the direction during the pressing-down of the cover button 132. As a result, the latch portions 14*b* and 14*c* lock the latch locking portions 14*a* and 14*b* of the latch 14, so that the lock of the openable cover 11 is retained in the closed state. Further, a contact portion 14*a* of the latch 14 abuts against an abutment portion 123*a* of the latch holder 123 by the urging force of the latch spring 15, so that a position of the latch 14 is determined, and thus a locking amount of the latch portions 14*b* and 14*c* relative to the latch locking portions 11*c* and 11*b* is ensured.

Next, a locking mechanism for switching a locked state in which the openable cover 11 is locked in the closed state by disabling the lock retention of the latch locking portions 11*a* and 11*b* of the openable cover 11 by the latch portions 14*b* and 14*c*, and a lock-released state will be described with reference to FIGS. 13 and 14.

Parts (a) and (b) of FIG. 14 are sectional views taken along A-A line of FIG. 12, in which part (a) shows a state before the openable cover 11 in the locked state of the locking mechanism for locking the openable cover 11 in the closed state is opened, and part (b) shows a state when the openable cover 11 in the locked state is opened.

The locking mechanism includes a solenoid 111 and a solenoid holding metal plate 112 which is mounted on the latch holder 123 and which holds the solenoid 111. Further, the locking mechanism includes a lock lever 17*a* rotatable about a shaft 112*a*, provided on the solenoid holding metal plate 112, by an operation of a plunger 111*a* of the solenoid 111, and includes a locking spring 18*a* as an urging member for urging the lock lever 17*a*. The locking mechanism further includes a locking member 17*b* which is moved by rotation of the lock lever 17*a* and which is slidably mounted so as to constitute a locking portion and a restricting portion.

Switching of the locking mechanism between lock(ing) and lock release is carried out, on the basis of a force relationship between the urging force of the locking spring 18*a* and an attraction force of the solenoid 111, by rotating the lock lever 17*a* between a locked position and a lock-released position and by moving the locking member 17*b* contacting the lock lever 17*a* in interrelation with the lock lever 17*a*. Parts (a) and (b) of FIG. 13 show a state in which the locking mechanism is moved to the lock-released position, and parts (a) and (b) of FIG. 14 show a state in which the locking mechanism is moved to the locked position.

When the locking mechanism is in the locked state, the force relationship is "(urging force of locking spring 18*a*)> (attraction force of solenoid 111)", so that the plunger 111*a*, the lock lever 17*a* and the locking member 17*b* move in directions of an arrow S, an arrow T and an arrow U, respectively, to the locked position of part (a) of FIG. 14.

As shown in part (b) of FIG. 14, when the user presses down the cover button 132 when the locking mechanism is in the locked state, the first link 120 engaging with the cover button 132 moves on the latch holder 123 against the urging force of the link spring 122. On the other hand, the locking member 17*b* restricts in movement of the second link 121 between the second link 121 and the latch holder 123, and therefore, the second link 121 cannot move. For this reason, the latch 14 moving in engagement with the second link 121 also cannot move, so that even when the cover button 132 is pressed, the lock of the latch locking portions 11*a* and 11*b* of the openable cover 11 cannot be released and thus the openable cover 11 is not opened.

On the other hand, in the lock released state, the force relationship is "urging force of locking spring 18)<(attraction force of solenoid 111)", so that the plunger 111*a*, the lock lever 17*a* and the locking member 17*b* move in directions of an arrow J, an arrow N and an arrow P, respectively, to the lock-released position. As shown in part (b) of FIG. 13, when the user presses down the cover button 132 when the locking mechanism is in the lock released state, the locking member 17*b* is moved to a position retracted from a restricting position where the locking member restricts movement of the second link 121, and therefore, the movement of the second link 21 is not restricted. Therefore, the latch portions 14*b* and 14*c* of the latch 14 move to positions where the lock of the latch locking portions 11*a* and 11*b* of the openable cover 11 are released, so that the lock of the openable cover 11 can be released and thus the openable cover 11 is opened.

Next, an operating portion detecting mechanism for detecting an operation of the cover button 132 by the user will be described with reference to FIGS. 13 and 14.

The operating portion detecting mechanism is constituted by the cover button 132, the first link 120, a switch lever 110*c* held rotatably about a rotation shaft 141*a*, and an operation detecting switch 19 mounted on the latch holder 123. The operation detecting switch 19 is a sensor for detecting that the cover button 132 is operated, and when the operation detecting switch 19 is pressed to an ON position, the operation detecting switch 19 detects that the user operated the cover button 132.

As shown in part (b) of FIG. 13, when the user presses down the cover button 132 in the arrow M direction during the lock released state of the locking mechanism, the first link 120 moves in the arrow L direction, so that the first link 120 and the switch lever 110*c* are engaged with each other. As a result, the switch lever 110*c* is rotated in the arrow Q direction and urges the operation detecting switch 19, so that the operation of the cover button 32 by the user is detected.

As shown in part (b) of FIG. 14, the first link 120 is also movable when the user presses down the cover button 132 in the arrow M direction during the locked state of the locking mechanism. Therefore, the switch lever 110*c* engaging with the first link 120 rotates in the arrow Q direction and urges the operation detecting switch 19, so that the operation of the cover switch 132 by the user is detected.

That is, as shown in part (b) of FIG. 13 and part (b) of FIG. 14, irrespective of the locked state and the lock released state of the locking mechanism, it is possible to detect that the cover button 132 was operated by the operation detecting switch 19.

Incidentally, in the embodiments described above, the operation detecting switch 19 was urged by moving the first link 120 by the cover button 132 and then by rotating the switch lever 110*c* by the first link 120. However, the present invention is not limited thereto, and it may only be required that the operation detecting switch 19 is pressed in interrelation with the cover button 132, and therefore, the cover button 32 may also directly press the operation detecting switch 19.

Third Embodiment

Next, a third embodiment will be described. Incidentally, in the following description, a constitution which is the same as those in the first and second embodiments will be described by quoting them and a redundant portion will be omitted from description. Further, constituent elements having the same functions as those in the first and second embodiments are represented by the same reference numerals or symbols and will be appropriately omitted from description.

Parts (a) and (b) of FIG. 17 are sectional views, of a principal part according to the second embodiment, taken along A-A line of FIG. 12. Part (a) of FIG. 17 shows a state before the openable cover 11 placed in a lock-released state in which a locking mechanism for locking the openable cover 11 in a closed state is lock-released is opened, and part (b) of FIG. 17 shows a state when the openable cover 11 placed in the lock-released state is opened.

In parts (a) and (b) of FIG. 17, a locking and lock-releasing mechanism for the latch locking portions 11*a* and 11*b* of the openable cover 11 includes a first link 120, a second link 121 constituting a latch 14, a latch holder 123, a latch spring 15 provided between the latch 14 and the latch holder 123, and a link spring 122*a* provided between the first link 120 and the latch holder 123.

The first link 120, the second link 121 and the latch 14 are slidably mounted on the latch holder 123. The latch 14 is positioned by abutment of a contact portion 14*e* thereof against an abutment portion 123*a* of the latch holder 23 by an urging force of the latch spring 15. The second link 121 and the first link 120 are constituted so as to be positioned by positioning of the latch 14.

FIG. 19 is an exploded perspective view of a principal part, in which the first link 120, the second link 121, the link spring 122*a*, the latch 14 and the latch holder 123 are extracted.

In FIG. 19, the latch 14 is slidably mounted on the latch holder 123 by engagement of holes 14*g* and 14*h*, provided in the latch 14, with bosses 123*j* and 123*k* provided on the latch holder 123. The second link 121 is provided with bosses 121*b* and 121*c* engageable with reverse L-shaped holes 123*e* and 123*f* provided at a pair of rising portions of the latch holder 123, and is slidably mounted on the latch holder 123. Further, the second link 121 has a constitution in which an abutment portion 121*a* of the second link 121 is urged by an urging portion 14*f* of the latch 14 by an urging force of the latch spring 15, and thus latch portions 14*b* and 14*c* move to positions of states in which the latch portions 14*b* and 14*c* lock the latch locking portions 11*a* and 11*b*.

The first link 120 is slidably mounted on the latch holder 123 by engagement of unshown groove portions, provided on the first link 120, with bosses 123*g* and 123*h* provided on the latch holder 123.

The first link 120 is urged in a rightward direction of FIG. 19 by a link spring 122*a* provided between the first link 120 and the latch holder 123, and the boss 123*g* of the latch holder 123 contacts the groove portion of the first link 120, so that the first link 120 is positioned. Further, the first link 120 moves in a leftward direction of FIG. 19 against the urging force of the link spring 122*a* when the cover button 132 is pressed down, and includes an urging portion 120*b* for urging an abutment portion 121*e* of the second link 121.

Next, an operation of the latch locking portions 11*a* and 11*b* of the openable cover 11 during release of the lock retention will be described.

In FIG. 12 and part (b) of FIG. 17, when the user presses down the cover button 132, as shown in part (b) of FIG. 17, the first link 120 engaging with the cover button 132 and the second link 121 urged by the first link 120 slide (move) in an arrow L direction. As a result, the latch 14 engaging with the second link 121 slides (moves) in the arrow L direction. By slide (movement) of the second link 121 to a predetermined position, the latch portions 14*b* and 14*c* of the latch 14 release the lock of the latch locking portions 11*a* and 11*b* of the openable cover 11, so that the openable cover 11 is opened.

Next, an operation of the latch locking portions 11*a* and 11*b* of the openable cover 11 during the lock retention will be described.

By the urging force of the latch spring 15 provided between the latch 14 and the latch holder 123 on which the latch 14 is mounted, the latch 14 and the first and second links 120 and 121 move in a direction opposite to the direction during the pressing-down of the cover button 132. As a result, the latch portions 14*b* and 14*c* lock the latch locking portions 14*a* and 14*b* of the latch 14, so that the lock of the openable cover 11 is retained in the closed state. Further, a contact portion 14*a* of the latch 14 abuts against an abutment portion 123*a* of the latch holder 123 by the urging force of the latch spring 15, so that a position of the latch 14 is determined, and thus a locking amount of the latch portions 14*b* and 14*c* relative to the latch locking portions 11*c* and 11*b* is ensured.

Next, a locking mechanism for switching a locked state in which the openable cover 11 is locked in the closed state by disabling the lock of the latch locking portions 11*a* and 11*b* of the openable cover 11 by the latch portions 14*b* and 14*c*, and a lock-released state will be described with reference to FIGS. 17 and 18.

Parts (a) and (b) of FIG. 18 are sectional views taken along A-A line of FIG. 12, in which part (a) shows a state before the openable cover 11 in the locked state of the locking mechanism for locking the openable cover 11 in the closed state is opened, and part (b) shows a state when the openable cover 11 in the locked state is opened.

The locking mechanism includes a solenoid 111 and a solenoid holding metal plate 112 which is mounted on the latch holder 123 and which holds the solenoid 111. Further, the locking mechanism includes a lock lever 17*a* rotatable about a shaft 112*a*, provided on the solenoid holding metal plate 112, by an operation of a plunger 111*a* of the solenoid 111, and includes a locking spring 18*a* for urging the lock lever 17*a*. The locking mechanism further includes a link moving member 17*c* which is moved by rotation of the lock lever 17*a* and which is slidably mounted so as to constitute a locking portion and a restricting portion.

Switching of the locking mechanism between lock(ing) and lock release is carried out, on the basis of a force relationship between the urging force of the locking spring 18*a* and an attraction force of the solenoid 111, by rotating the lock lever 17*a* between a locked position and a lock-released position and by moving the link moving member 17*c* contacting the lock lever 17*a* in interrelation with the lock lever 17*a*. Parts (a) and (b) of FIG. 17 show a state in which the locking mechanism is moved to the lock-released position, and parts (a) and (b) of FIG. 18 show a state in which the locking mechanism is moved to the locked position.

When the locking mechanism is in the locked state, the force relationship is "(urging force of locking spring 18*a*)> (attraction force of solenoid 111)". As a result, the plunger 111*a*, the lock lever 17*a*, the link moving member 17*c* and the second link 121 move in directions of an arrow S, an arrow T, an arrow U, and the arrow U, respectively, to the locked position shown in part (a) of FIG. 18.

As shown in part (b) of FIG. 18, when the user presses down the cover button 132 when the locking mechanism is in the locked state, the first link 120 engaging with the cover button 132 moves on the latch holder 123 against the urging force of the link spring 122*a*. When the locking mechanism is in the locked state, the link moving member 17*c* moves the second link 121 in the arrow U direction, and therefore, the urging portion 120*b* of the first link 120 cannot urge the abutment portion 121*d* of the second link 121, so that the first link 120 and the second link 121 cannot move in interrelation with each other. Therefore, even when the cover button 132 is pressed, the lock of the latch locking portions 11*a* and 11*b* of the openable cover 11 cannot be released and thus the openable cover 11 is not opened.

On the other hand, in the lock released state, the force relationship is "urging force of locking spring 18) 21 (attraction force of solenoid 111)". As a result, the plunger 111*a*, the lock lever 17*a*, the link moving member 17*c* and the second link 121 move in directions of an arrow J, an arrow N, an arrow P and the arrow P, respectively, to the lock-released position.

As shown in part (b) of FIG. 17, the user presses down the cover button 132 when the locking mechanism is in the lock released state. Then, the link moving member 17*c* moves to a retracted position where the link moving member 17*c* does not move the second link 121, and therefore, the urging portion 120*b* of the first link 120 urges the abutment portion 121*d* of the second link 121, so that the first link 120 and the second link 121 move in interrelation with each other. As a result, the latch portions 14*b* and 14*c* of the latch 14 movable in engagement with the second link 121 move to positions where the lock of the latch locking portions 11*a* and 11*b* of the openable cover 11 is released, so that the lock of the openable cover 11 can be released and thus the openable cover 11 is opened.

Next, an operating portion detecting mechanism for detecting an operation of the cover button 132 by the user will be described with reference to FIGS. 17 and 18.

The operating portion detecting mechanism is constituted by the cover button 132, the first link 120, a switch lever 110*c* held rotatably about a rotation shaft 141*a*, and an operation detecting switch 19 mounted on the latch holder 123. The operation detecting switch 19 is a sensor for detecting that the cover button 132 is operated, and when the operation detecting switch 19 is pressed to an ON position, the operation detecting switch 19 detects that the user operated the cover button 132.

As shown in part (b) of FIG. 17, when the user presses down the cover button 132 in the arrow M direction during the lock released state of the locking mechanism, the first link 120 moves in the arrow L direction, so that the first link 120 and the switch lever 110*c* are engaged with each other. As a result, the switch lever 110*c* is rotated in the arrow Q direction and urges the operation detecting switch 19, so that the operation of the cover button 32 by the user is detected.

As shown in part (b) of FIG. 18, the first link 120 is also movable when the user presses down the cover button 132 in the arrow M direction during the locked state of the locking mechanism, and engages with the first link 120. Therefore, the switch lever 110*c* rotates in the arrow Q direction and urges the operation detecting switch 19, so that the operation of the cover switch 132 by the user is detected.

Fourth Embodiment

Next, a fourth embodiment will be described. In this embodiment, similarly as in the first embodiment, a constitution in which the lock of the openable cover is manually released and the openable cover can be opened during emergency is employed. However, in the first embodiment, the constitution in which the lock of the openable cover is released by using the tool is employed, but the present invention is not limited thereto. Therefore, in this embodiment, a constitution in which the lock of the openable cover is manually released and the openable cover can be opened is employed. In the following, first, a general structure of an image forming apparatus according to this embodiment will be described together with an operation during image formation with reference to the drawings.

An image forming apparatus A is an image forming apparatus of an intermediary transfer tandem type in which toner images of four colors of yellow Y, magenta M, cyan C and black K are transferred onto the intermediary transfer belt and thereafter are transferred onto a sheet and thus an image is formed on the sheet. Incidentally, in the following description, although suffixes Y, M, C and K are added to members using toners of the respective colors, constitutions and operations of the respective members are the substantially same except that the colors of the toners to be used are different from each other, and therefore, the suffixes will be appropriately omitted except for the case where distinction (determination) is required.

FIG. 20 is a schematic sectional view of the image forming apparatus A. The image forming apparatus A includes an image forming portion for forming toner images onto a sheet S, a sheet feeding portion for feeding the sheet toward the image forming portion, and a fixing portion for fixing the toner images on the sheet.

As shown in FIG. 20, the image forming portion includes process cartridges 257 (257Y, 257M, 257C, 257K), an intermediary transfer unit 259 and a laser scanner unit 2103. The intermediary transfer unit 259 includes primary transfer rollers 254 (254Y, 254M, 254C, 254K), an intermediary transfer belt 2102, a driving roller 255, a secondary transfer roller 2015, a secondary transfer opposite roller 256 and the like.

In the respective process cartridges 257, toners of yellow, magenta, cyan and black are accommodated, respectively, and toner sensors 235 for detecting amounts of the accommodated toners are provided, respectively. The process cartridges 257 include photosensitive drums 251 (251Y, 251M, 251C, 251K), charging rollers 252 (252Y, 252M, 252C, 252K) and developing rollers 253 (253Y, 253M, 253C, 253K), respectively.

Next, an image forming operation will be described. First, when a controller 230 shown in FIG. 30 receives an image forming job signal, the sheet S stacked and accommodated in a sheet cassette 2107 is fed to a registration roller 2110 by a feeding roller 2108 and a conveying roller 2109. The registration roller 2110 corrects oblique movement of the sheet S and conveys the sheet S to a secondary transfer portion formed by the secondary transfer roller 2105 and the secondary transfer opposite roller 256.

On the other hand, in the image forming portion, first, a bias (voltage) is applied to the charging roller 252, whereby the surface of the photosensitive drum 251 contacting the charging roller 252 is electrically charged uniformly. Thereafter, depending on image data transmitted from an external device or the like, the surface of the photosensitive drum 251 is irradiated with laser light by the laser scanner unit 2103. As a result, an electrostatic latent image depending on the image data is formed on the surface of the photosensitive drum 251.

Thereafter, a bias is applied to the developing roller 253, whereby the toner of an associated color is deposited on the electrostatic latent image formed on the surface of the photosensitive drum 251. As a result, a toner image is formed on the surface of the photosensitive drum 251. The thus-formed toner image is sent to a primary transfer portion formed by the photosensitive drum 251 and the primary transfer roller 254 with rotation of the photosensitive drum 251.

The toner images of the respective colors sent to the primary transfer portions are transferred onto the intermediary transfer belt 2102 by applying a bias, of an opposite polarity to a charge polarity of the toner, to each of the primary transfer rollers 254. As a result, the toner images of the respective colors are successively superposed on the intermediary transfer belt 2102, so that a full-color toner images is formed.

Next, the toner image is sent to a secondary transfer portion by rotation of the intermediary transfer belt 2102. Then, at the secondary transfer portion, a bias is applied to a secondary transfer roller 2105, whereby the toner image on the intermediary transfer belt 2102 is transferred onto the sheet S.

Thereafter, the sheet S on which the toner image is transferred is sent to a fixing device 2111. The toner image is subjected to a heating and pressing process by the fixing device 211, so that the toner image is fixed on the sheet S. Thereafter, the sheet S is discharged onto a discharge portion 2113 by a discharging roller 2112.

<Openable Door>

Next, a constitution of an openable door 21 will be described.

FIGS. 21 and 22 are perspective views of an image forming apparatus A. Here, part (a) of FIG. 21 shows a state in which the openable door 21 and a cover member 2222 are in closed positions. Part (b) of FIG. 21 shows a state in which the openable door 21 is in the closed position and the cover member 2222 is in an open position. Part (a) of FIG. 22 shows a state in which the cover member 2222 is in the closed position and the openable door 21 is in an open position. Part (b) of FIG. 22 shows a state in which a cartridge tray 258 is pulled out from the state of part (a) of FIG. 22.

As shown in FIGS. 21 and 22, the image forming apparatus A includes an operating panel 214 (display portion) capable of displaying various pieces of information. Further, the operating panel 214 is constituted so as to be operable by the user, and the user is capable of performing various settings for image formation, such as the number of sheets subjected to the image formation and setting of the sheet S, by operating the operating panel.

Further, the image forming apparatus A is provided with the openable door 21 capable of being opened and closed relative to an apparatus main assembly 2100. The openable door 21 is rotatably supported by the apparatus main assembly 2100 and moves between an open position where the openable door 21 is open relative to the apparatus main assembly 2100 and a closed position where the openable door 21 is closed relative to the apparatus main assembly 2100 by being rotated. That is, the openable door 21 is constituted so as to be movable between the closed position where the openable door 21 covers an opening of the apparatus main assembly 2100 and the open position where the opening of the apparatus main assembly 2100 is exposed. Further, the openable door 21 is provided with two engaging claws 1*a* (portions-to-be-engaged).

When the openable door 21 is in the open position, the cartridge tray 258 holding a process cartridge 257 is exposed through the opening. The user or a service person is capable of mounting and dismounting the cartridge 257 relative to the apparatus main assembly 2100 by linearly pulling out the cartridge tray 258 through the opening of the apparatus main assembly 2100. Further, the cartridge tray 258 is accommodated in the apparatus main assembly 2100, so that the process cartridge 257 mounted in the cartridge tray 258 is mounted in the apparatus main assembly 2100. Thus, the process cartridge 257 is constituted so as to be mountable in and dismountable from the apparatus main assembly 2100 of the image forming apparatus 2100.

The image forming apparatus A is provided with the cover member 2222 which is openable relative to the openable door 21. The cover member 2222 is rotatably supported by the openable door 21 and is moved between an open position where the cover member 2222 is open relative to the openable door 21 and a closed position where the cover member 2222 is closed relative to the openable door 21, by being rotated. When the cover member 2222 is opened, an inserting opening 21*c* which is a hole for permitting insertion of an unshown tool is exposed. That is, the cover member 2222 is constituted so as to be movable between the closed position where the cover member 2222 covers the insertion opening 21*c* and the open position where the insertion opening 21*c* is exposed. Specific uses of the insertion opening 21*c* will be described later. Incidentally, the cover member 2222 may also be changed to a sheet feeding tray or the like for stacking sheets S to be manually fed, for example.

The image forming apparatus A includes a latch member 24 (engaging member) for locking the openable door 21, being in the closed position, to the apparatus main assembly 2100. The latch member 24 includes two latches 24*a*. Parts (a) and (b) of FIG. 23 are enlarged perspective views of the latch member 24 and a periphery thereof. As shown in FIG. 23, the latch member 24 is urged in an arrow K1 direction by a latch spring 25, whereby the latch member 24 and a button 22 contact each other. Incidentally, the button 22 (urging member) is provided so as to be exposed from an outer casing cover 2201 of the apparatus main assembly 2100 and is constituted so as to be capable of being urged from an outside of the apparatus main assembly 2100.

As shown in part (a) of FIG. 23, when the openable door 21 is gradually closed, inclined portions 24*b* of the latches 24*a* of the latch 24 and inclined surfaces 11*b* of engaging claws 11*a* of the openable door 21 contact each other, when the openable door 21 is further closed, the inclined portions 21*b* of the engaging claws 21*a* move along the inclined surfaces 24*b* of the latches 24 while urging the latch member 24 in an arrow K2 direction. Thereafter, when the openable door 21 is closed to the end, the inclined portions 21*b* of the engaging claws 11*a* and the inclined surfaces 24*b* of the latches 24*a* are in non-contact with each other, so that the latch member 24 is moved in the arrow K1 direction by an urging force of the latch spring 25. As a result, the latches 24*a* and the engaging claws 21*a* engage with each other, so that the openable door 21 is locked to the apparatus main assembly 2100.

Further, as shown in part (b) of FIG. 23, when the button 22 is pressed in the arrow K2 direction by the user or the service person, the latch member 24 contacting the button 22 slides (moves) in the arrow K2 direction together with the button 22 against the urging force of the latch spring 25 in the arrow K1 direction. As a result, engagement between the latches 4*a* and the engaging claws 21*a* is released (eliminated), so that the lock of the openable door 21 to the apparatus main assembly 2100 is released. Thus, in a state in which the lock is released, the user or the service person is capable of manually opening the openable door 21.

<Restricting Unit>

Next, a constitution of a restricting unit 2200 (restricting portion) for restricting movement of the button 22 will be described.

Part (a) of FIG. 24 is a perspective view of the restricting unit 2200. Part (b) of FIG. 24 is an exploded perspective view of the restricting unit 2200. Part (a) of FIG. 25 is a front view of the restricting unit 2200. Part (b) of FIG. 25 is a top (plan) view of the restricting unit 2200.

As shown in FIGS. 24 and 25, the restricting unit 2300 includes a holder 2210, a slidable member 2211, a stopper member 27, a solenoid 211, a detecting arm 2212, and a button sensor 29.

The slidable member 2211 is supported so as to be movable in arrow K1 and K2 directions relative to the holder 2210 and is urged in the arrow K1 direction by a slide spring 14. As a result, a button contact portion 2211*a* of the slidable member 2211 is abutted against the button 22.

The stopper member 27 (restricting member) is supported so as to be swingable about a stopper shaft 27*a* thereof in arrow R1 and R2 directions by engagement of the stopper shaft 27*a* with a supporting hole 2210*a* of the holder 2210, and is urged in the arrow R1 direction by an urging force of a stopper spring 28. Here, a position (shown in FIG. 24) where the stopper member 27 swings in the arrow R1 direction and opposes a stopper contact portion 2211*b* of the slidable member 2211 is referred to as a restricting position. The stopper member 27 restricts movement of the button 22 at the restricting position as described later. In a state in which the stopper member 27 is in the restricting position and the button 22 is not pressed, there is a distance P between the stopper contact portion 2211*b* of the slidable member 2211 and the stopper member 27.

The solenoid 211 is fixed to the holder 2210 with screws 2217. Further, into a plunger 211*a* of the solenoid 211, a connecting shaft 211*b* is mounted, and the connecting shaft 211*b* engages with a groove 27*b* of the stopper member 27, so that the solenoid 211 and the stopper member 7 are connected to each other. When a current is supplied to the solenoid 211, a magnetic force is generated, so that the plunger 211*a* moves in an arrow K3 direction. As a result, the stopper member 27 connected to the plunger 211*a* swings from the restricting position in the arrow R2 direction against an urging force of the stopper spring 28 in the arrow R1 direction. Thus, a position (shown in FIG. 28) where the stopper member 27 swings from the restricting position in the arrow R2 direction is referred to as a released position.

Here, an attraction force of a permanent magnet (not shown) of the solenoid 211 is set so as to be stronger than the urging force of the stopper spring 28. Accordingly, even after supply of the current to the solenoid 211 is stopped, the stopper member 27 maintains a state in which the stopper member 27 is in the released position. Further, in the case where the stopper member 27 is in the released position, when a current flowing in a direction opposite to the direction during movement of the plunger 211*a* in the arrow K3 direction is supplied to the solenoid 211, the plunger 211*a* swings in an arrow K4 direction by a magnetic force and the urging force of the stopper spring 28. As a result, the stopper member 27 moves from the released position to the restricting position. That is, the stopper member 27 which is a part of the restricting unit 2200 is constituted so as to be movable between the restricting position and the released position by the supply of the current to the solenoid 211 (driving source). Incidentally, whether the stopper member 27 is in either position of the restricting position or the released position is detectable by a stopper sensor 234 (FIG. 30).

The button sensor 29 is supported by the holder 2210 by engagement of a sensor shaft 2210*c* of the holder 2210 in a supporting hole 29*b* thereof. The button sensor 29 is provided with a flag 29*a* swingable in arrow R3 and R4 directions. As described later, when the button 22 is pressed, the flag 29*a* swings in the arrow R3 direction, so that detection that the button 22 was pressed is made.

A detecting arm 2212 is supported swingably in arrow R5 and R6 directions relative to an arm shaft 2201*b* of the holder 2210 and is urged in the arrow R5 direction by an arm spring 2215. As a result, the detecting arm 2212 contacts an arm supporting portion 2211*c* of the slidable member 2211. Incidentally, an urging force of the slidable member 2214 is set so as to be larger than the urging force of the arm spring 2215. Accordingly, the slidable member 2211 does not move in the arrow K2 direction by the urging force of the arm spring 2215 and is moved in the arrow K1 direction by the urging force of the slide spring 2214, and thus is abutted against the button 22.

<Restricting Operation by Restricting Unit>

Next, a restricting operation of the movement of the button 22 by the restricting unit 2200 will be described.

Parts (a) and (b) of FIG. 6 are schematic views of the restricting unit 2200 when the stopper member 27 is in the restricting position and the button 22 is pressed, in which part (a) is a front view, and part (b) is a top view. FIG. 27 is a perspective view of the restricting unit 2200 and the lock member 24 when the stopper member 27 is in the restricting position and the button 22 is urged.

As shown in part (a) of FIG. 26, when the button 22 is pressed in the arrow K2 direction, an urging force is transmitted to the button contact portion 2211*a* contacting the button 22, so that the slidable member 2211 moves together with the button 22 in the arrow K2 direction. Further, to the button 22, the latch 24 is also contacted (FIG. 27), and therefore, when the button 22 moves in the arrow K2 direction, the latch member 24 also moves together with the button 22 in the arrow K2 direction.

Here, in the case where the stopper member 27 is in the restricting position, when the slidable member 2211 move in the arrow K2 direction by a distance P (FIG. 24), the stopper contact portion 2211*b* of the slidable member 2211 contacts the stopper member 27. As a result, movement of the slidable member 2211 in the arrow K2 direction is restricted, and movement of the button 22 and the lock member 24 in the arrow K2 direction is also restricted. That is, the stopper member 27 enters a region, where the slidable member 2211 passes, when the button 22 is pressed, and restricts movement of the slidable member 2211.

As shown in FIG. 27, when the stopper member 27 positioned at the restricting position and the stopper contact portion 2211*b* of the slidable member 2211 contact each other, a state in which the latches 24*a* of the latch member 24 and the engaging claws 21*a* of the apparatus main assembly 2100 engage with each other is formed. That is, when the stopper member 27 is positioned at the restricting position, the restricting unit 2200 restricts the movement of the button 22 in the arrow K2 direction by contact of the slidable member 2211, contacting the stopper member 27, with the button 22, so that the stopper member restricts release of the engagement between the latch 4*a* and the engaging claw 21*a*. Accordingly, in the case where the stopper member 27 is in the restricting position, the lock of the openable door 21 cannot be released even when the button 22 is pressed, so that the openable door 21 cannot be opened.

Further, as shown in part (b) of FIG. 26, when the button 22 is pressed and the arm supporting portion 2211*c* of the slidable member 2211 is moved in the arrow K2 direction, the arm supporting portion 2211*c* is separated from the detecting arm 2212, so that the detecting arm 2212 swings in the arrow R5 direction by the urging force of the arm spring 2215. As a result, the detecting arm 2212 presses the flag 29*a* of the button sensor 29, so that the flag 29*a* swings in the arrow R3 direction, and thus detection that the button 22 was pressed is made by the button sensor 29.

Parts (a) and (b) of FIG. 28 are schematic views of the restricting unit 2200 when the stopper member 27 is in the released position and the button 22 is pressed, in which part (a) is a front view and part (b) is a top view. FIG. 29 is a perspective view of the restricting unit 2200 and the latch member 24 when the stopper member 27 is in the released position and the button 22 is pressed.

As shown in part (a) of FIG. 28, when the button 22 is pressed in the arrow K2 direction, the urging force is transmitted to the button contact portion 2211*a* of the slidable member 2211 contacting the button 22, so that the slidable member 2211 moves together with the button 22 in the arrow K2 direction. To the button 22, the latch member 24 is also contacted (FIG. 29), and therefore, when the button 22 moves in the arrow K2 direction, the latch member 24 also moves together with the button 22 in the arrow K2 direction.

Here, in the case where the stopper member 27 is in the released position, different from the case where the stopper member 27 is in the restricting position, the slidable member 2211 is not restricted from moving in contact with the stopper member 27. Accordingly, the slidable member 2211 moves in the arrow K2 direction until the detecting arm 2212 swinging in an arrow K6 direction with movement of the slidable member 2211 contacts the arm contact portion 2210*d*. That is, in the case where the stopper member 27 is in the released position, the slidable member 2211 moves in K2 direction in a distance longer than the distance in the case where the stopper member 27 is in the restricting position.

As shown in FIG. 29, when the detecting arm 2212 contacts the arm contact portion 2210*d* of the holder 2210 and movement of the slidable member 2211 in the arrow K2 direction is restricted, engagement between the latch 4*a* of the latch member 24 and the engaging claw 21*a* of the apparatus main assembly 2100 is in a released state. That is, when the stopper member 27 is in the released position, the restricting unit 2200 permits the movement of the button 22 in the arrow K2 direction until the engagement between the latch 24*a* and the engaging claw 21*a* is released. Accordingly, in the case where the stopper member 27 is in the released position, when the button 22 is pressed, the lock of the openable door 21 is released, so that the openable door 21 can be opened. That is, the restricting unit 2200 is constituted so as to be capable of being placed in a state in which the restricting unit 2200 contacts the button 22 and restricts the movement of the button 22 and a state in which the restricting unit 2200 is prevented from contacting the button 22 and permits movement of the latch member 24 by the button 22.

Further, as shown in part (b) of FIG. 28, when the button 22 is pressed and the arm contact portion 2211*c* of the slidable member 2211 moves in the arrow K2 direction, the arm supporting portion 2211*c* is separated from the detecting arm 2212, so that the detecting arm 2212 swings in the arrow R5 direction by the urging force of the arm spring 2215. As a result, the detecting arm 2212 urges the flag 29*a* of the button sensor 29 and the flag 29*a* swings in the arrow R3 direction, so that detection that the button 22 was pressed is made by the button sensor 29.

<Controller>

Next, of a system constitution of the image forming apparatus A, a system constitution of a portion particularly relating to the openable door 21 and the restricting unit 2200 will be described.

FIG. 30 is a block diagram showing a part of the system constitution of the image forming apparatus A. As shown in FIG. 30, the image forming apparatus A includes a controller 230 including a CPU 231, a ROM 232 and a RAM 233. The ROM 232 stores various data such as a control program and a table and the like. The CPU 231 carries out various calculation processes on the basis of the control program or information stored in the ROM 232. The RAM 233 temporarily stores data.

That is, in the controller 230, the CPU 231 controls various devices of the image forming apparatus A on the basis of the control program stored in the ROM 232 while using the RAM 233 as an operational space (area). Further, the controller 230 (CPU 231) carries out the above-described image forming operation, such as formation of the toner image on the photosensitive drum 251 through the control of the various devices.

To the controller 230, an operating panel 214 is connected. As described above, the user operates the operating panel 214, so that the user is capable of executing various settings relating to the image formation and an image forming job. Further, the controller 230 receives a signal from the operating panel 214 and causes the various devices of the image forming apparatus A to operate.

Further, to the controller 230, a power source 236 for supplying the current to the solenoid 211 is connected. The controller 230 controls the solenoid 211 through control of the power source 236, so that the stopper member 27 is moved between the restricting position and the released position.

Further, to the controller 230, a toner sensor 235 (toner detecting means), a button sensor 29 (detecting means) and a stopper sensor 234 are connected. The controller 230 executes a cartridge exchange sequence described later by using a detection result of these sensors.

<Cartridge Exchange Sequence>

Next, the cartridge exchange sequence which is a sequence when a process cartridge 257 is exchanged will be described using a flowchart shown in FIG. 31. Incidentally, this sequence is performed every time when an image is formed by the image forming apparatus A.

When the cartridge exchange sequence is started, first, the stopper sensor 234 detects whether the stopper member 27 is in either position of the restricting position or the released position (S31). Next, even in the case where the stopper member 27 is in either position (the restricting position, the released position), the toner sensor 235 detects a toner amount in the process cartridge 257 (S32, S33, S36).

Next, in the case where the stopper member 27 is in the restricting position and the toner amount in the developing cartridge 257 is less than the predetermined amount, the controller 230 causes the power source 236 to supply a current to the solenoid 211, so that the stopper member 27 is moved from the restricting position to the retracted (released) position (S34, S35). Incidentally, in the case where the toner amount in the process cartridge 257 is the predetermined amount or more, the controller 230 causes the power source 236 not to supply the current to the solenoid 211, so that the stopper member 27 is kept at the restricting position as it is (S34).

Further, in the case where the stopper member 27 is in the retracted (released) position and the toner amount in the process cartridge 257 is the predetermined amount or more, the controller 230 causes the power source 236 to supply the current to the solenoid 211, so that the stopper member 27 is moved from the retracted (released) position to the restricting position (S37, S38). Incidentally, in the case where the toner amount in the process cartridge 257 is less than the predetermined amount, the controller 230 causes the power source 236 not to supply the current to the solenoid 211, so that the stopper member 27 is kept at the released (retracted) position as it is (S37). That is, the controller 230 causes the stopper member 27 to be positioned at the restricting position in the case where the toner amount in the process cartridge 257 is the predetermined amount or more and to be positioned at the retracted (released) position in the case where the toner amount in the process cartridge 246 is less than the predetermined amount.

Next, when pressing of the button 22 is detected by the button sensor 29, the toner sensor 235 detects the toner amount in the process cartridge 257 (S39, S40). Thereafter, in the case where the toner amounts in all the process cartridges 257 are the predetermined amount or more, the controller 230 causes the operating panel 214 to display a message to the effect that timing is not exchange timing of the process cartridge 257 and ends the cartridge exchange sequence (S41, S43). Further, in the case where at least one of the process cartridges in which the toner amounts are less than the predetermined amount exists, the controller 230 causes the operating panel 214 to display the process cartridge(s) 257 required to be exchanged and ends the cartridge exchange sequence (S41, S42). Incidentally, in addition to display at the operating panel 214, the process cartridge(s) 257 required to be exchanged may also be notified through voice.

<Method of Manually Releasing Lock of Openable Door>

In the image forming apparatus A, in the case where the current cannot be supplied to the solenoid 211 due to an out-of-order or the like of an electric system, lock of the openable door 21 cannot be electrically released. Therefore, a method of manually release the lock of the openable door 21 will be described.

As shown in part (a) of FIG. 21, a person who releases the lock (releaser) moves the cover member 2222 from a closed position to an open position in the case where the lock of the openable door 21 is manually released, so that the insertion opening 21*c* is exposed. Here, the insertion opening is a hole for permitting access to one of the latches 24*a* of the latch member 24. The releaser makes access to the latch 24*a* by inserting an unshown tool into the insertion opening 21*c* and then operates the unshown tool, so that the latch 24*a* is urged toward the arrow K2 direction.

The latch member 24 is constituted as a separate member from the button 22 and the stopper member 27, and therefore, can be independently moved. Accordingly, by this operation, an entirety of the latch member 24 moves in the arrow K2 direction, so that engagement between the latch 24*a* and the engaging claw 21*a* is released. That is, the latch member 24 is movable from an outside of the apparatus main assembly 2100, and even in a state in which movement of the button 22 is restricted by the restricting unit 2200, the engagement between the latch 24*a* of the latch member 24 and the engaging claw 21*a* is made releasable. Thus, the releaser is capable of manually releasing the lock of the openable door 21 even in the case where the current cannot be supplied to the solenoid 211 due to the out-of-order or the like of the electric system.

According to the embodiments described above, in the case where by the remaining toner amount detection, the cartridge mounted is still usable, opening of the openable cover covering the cartridge mounting portion is locked. Therefore, the cartridge cannot be exchanged, so that it is possible to prevent that the cartridge which is still usable is exchanged early and thus the user bears an excessive cost.

Further, according to the above-described embodiments, in the case where by the remaining toner amount detection, the cartridge mounted is still usable and the openable cover is locked in the closed state, for the user who intends to open the openable cover, display that the opening up of the openable cover is made. Therefore, it is possible to prevent that the user cannot recognize the lock of the opening up of the openable cover and breaks the openable cover by forcedly opening the openable cover.

Further, according to the above-described embodiments, in the case where the cartridge which is used up is exchanged, the openable cover is automatically locked to the closed state again until a new (fresh) cartridge which has been newly mounted is in a used-up state to be detected through the remaining toner amount detection. Therefore, it is possible to prevent that the cartridge which is mounted and which is still usable is exchanged.

Incidentally, in the above-described embodiments, the solenoid is used as the electric driving portion for releasing the lock of the openable cover in the closed state, but other electric driving devices such as a DC motor and a stepping motor can be similarly applied.

Further, in the above-described embodiments, an example in which determination of the remaining toner amount is carried out by detecting an actual remaining toner amount by the remaining toner amount detecting sensor was shown. On the other hand, the remaining toner amount may also be determined by estimating amount of the toner from an integrated value of a density of print data or an integrated value of dot data of the latent image.

Further, in the above-described embodiments, exchange of the developing (developer) cartridge, which is in the state in which the cartridge is to be exchanged and which is used up, with a new and usable developing cartridge is determined by the remaining toner amount detection after the openable cover is closed, and then the openable cover is locked again in the closed state. On the other hand, the exchange of the developing cartridge, which is in the state in which the cartridge is to be exchanged and which is used up, with the new and usable developing cartridge is detected by closing of the openable cover and then the openable cover may also be locked again in the closed state without performing determination by the remaining toner amount detection. In that case, thereafter, the exchange to the new and usable developing cartridge is determined by the remaining toner amount detection and then the lock of the openable cover in the closed state may only be required to be controlled.

Further, in the above-described embodiments, even when the locking mechanism is in the lock released state, the lock of the openable cover is retained, but the locking mechanism is in the lock released state and then the lock retention of the openable cover may also be released.

In the above-described embodiments, the image forming apparatus in which the toner is used as the developer in the developer cartridge to be mounted was described as an example, but the present invention is similarly applicable to even an image forming apparatus in which another developer such as ink is used.

In the above-described embodiments, the developing (developer) cartridge or the process cartridge was described as an example of the consumable for which the state in which the cartridge is to be exchanged is determined, but the present invention is similarly applicable to even a drum cartridge and a toner cartridge. Further, the present invention is also applicable to even other consumables. For example, in the above-described embodiments, although the image forming apparatuses of the electrophotographic type were described, the present invention is not limited thereto and is also applicable to a constitution of an image forming apparatus of an ink jet type in which the openable door 21 is opened and then an ink cartridge is mounted and dismounted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2019-005954 filed on Jan. 17, 2019, and 2019-040681 filed on Mar. 6, 2019, which are hereby incorporated by reference herein in their entirety.

What is claimed is:

1. An image forming apparatus comprising:

a main assembly including a mounting portion on which a consumable for image formation is mounted;

an openable member provided with a portion-to-be-engaged and configured to cover the mounting portion;

an engaging member provided on said main assembly and configured to be movable between (i) an engaging position where said engaging member engages with said portion-to-be-engaged of said openable member positioned at a closed position so as to restrict movement of said openable member relative to said main assembly and (ii) a released position where engagement of said engaging member and said portion-to-be-engaged is released;

an operating portion configured to move said engaging member such that said engaging member is moved from the engaging position to the released position in interrelation with movement of said operating portion;

a locking portion configured to be movable between a lock position and an unlock position, wherein (i) when said locking portion is in the lock position, a releasing operation for moving said engaging member from the engaging position to the released position is restricted, and (ii) when said locking portion is in the unlock position, the releasing operation is allowed;

an electric driving portion configured to move said locking portion; and a controller configured to control said electric driving portion, wherein when said controller receives a signal indicating that said consumable is in an exchange state in which the consumable is to be exchanged, said controller controls said electric driving portion such that said electric driving portion moves said locking portion from the lock position to the unlock position.

2. An image forming apparatus according to claim 1, wherein when said engaging member engages with said portion-to-be-engaged of said openable member positioned at the closed position, movement of said openable member from a position where said openable member covers said mounting portion is restricted.

3. An image forming apparatus according to claim 1, further comprising a releasing portion configured to be moved manually, said releasing portion being capable of moving said engaging member from the engaging position to the released position, in a state in which said locking portion is in the lock position.

4. An image forming apparatus according to claim 3, wherein said releasing portion is accessible from an outside of said main assembly.

5. An image forming apparatus according to claim 4, wherein said releasing portion is accessible from the outside of said main assembly through a hole provided in said openable member.

6. An image forming apparatus according to claim 5, further comprising a cover member supported by said openable member and movable between a position where said cover member covers the hole and a position where the hole is exposed.

7. An image forming apparatus according to claim 1, wherein said consumable is a developer cartridge configured to supply a developer for image formation, and wherein said controller controls said electric driving portion by regarding, as the exchange state, a state in which a remaining amount of the developer in said developer cartridge mounted in said mounting portion is determined as being a predetermined amount or less.

8. An image forming apparatus according to claim 1, further comprising a display portion configured to display information relative to engagement between said engaging member and said portion-to-be-engaged portion.

9. An image forming apparatus according to claim 1, further comprising a closing detecting portion configured to detect closing of said openable member.

10. An image forming apparatus according to claim 1, wherein said electric driving portion comprises a solenoid for moving said lock portion by a plunger.

11. An image forming apparatus according to claim 1, further comprising an urging member configured to urge said lock portion, wherein said electric driving portion moves said lock portion against an urging force of said urging member.

12. An image forming apparatus according to claim 1, further comprising a connecting member, wherein said operating member is configured to urge said engaging member via said connecting member.

13. An image forming apparatus according to claim 12, wherein when said lock portion is in the lock position, said lock portion is capable of restricting movement of said connecting member.

14. An image forming apparatus according to claim 12, wherein said connecting member is movable between (i) a first position where said connecting member connects said operating portion and said engaging member and (ii) a second position retracted from the first position, and wherein said connecting member is positioned in the first position when said lock portion is in the unlock position, and said connecting member is positioned in the second position when said lock portion is in the lock position.

15. An image forming apparatus according to claim 1, wherein said operating portion is configured to contact said engaging member.

16. An image forming apparatus according to claim 1, wherein said operating portion is configured to urge said engaging member.

17. An image forming apparatus according to claim 1, wherein when said lock portion in the lock position, said lock portion is capable of restricting movement of said operating portion.

18. An image forming apparatus according to claim 1, further comprising an operation detecting portion configured to detect movement of said operating portion.

19. An image forming apparatus according to claim 18, wherein said operation detecting portion is capable of detecting the movement of said operating portion when said operating member is moved in a state in which said lock portion is in the lock position.

20. An image forming apparatus according to claim 19, further comprising an output portion, wherein when said operation detecting portion detects the movement of said operating portion in a state in which said lock portion is in the lock position, said output portion is capable of outputting an output indicating that said consumable is not in the exchange state.

21. An image forming apparatus according to claim 20, wherein said output portion includes a display configured to display information indicating that said consumable is not in the exchange state.

22. An image forming apparatus according to claim 1, wherein said operating member is provided on said openable member.

23. An image forming apparatus according to claim 1, wherein said operating member includes a lever.

24. An image forming apparatus according to claim 1, wherein said operating member is provided on said main assembly, and said operating member includes a button.

25. An image forming apparatus according to claim 1, wherein when said controller does not receive the signal indicating that said consumable is in the exchange state, said locking portion is located in the lock position.

26. An image forming apparatus according to claim 1, wherein said consumable includes a plurality of cartridges, and wherein said openable member is configured to cover a portion to which said plurality of cartridges is mounted.

* * * * *